US009631437B2

(12) United States Patent
Dale et al.

(10) Patent No.: US 9,631,437 B2
(45) Date of Patent: Apr. 25, 2017

(54) SYSTEMS AND METHODS FOR MANAGING PRESSURES IN CASING ANNULI OF SUBTERRANEAN WELLS

(75) Inventors: Bruce A. Dale, Sugar Land, TX (US); David A. Baker, Bellaire, TX (US); Michael S. Chelf, Humble, TX (US); Charles S. Yeh, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 612 days.

(21) Appl. No.: 13/991,856

(22) PCT Filed: Dec. 6, 2011

(86) PCT No.: PCT/US2011/063573

§ 371 (c)(1),
(2), (4) Date: Jun. 5, 2013

(87) PCT Pub. No.: WO2012/106028

PCT Pub. Date: Aug. 9, 2012

(65) Prior Publication Data

US 2013/0299180 A1 Nov. 14, 2013

Related U.S. Application Data

(60) Provisional application No. 61/439,164, filed on Feb. 3, 2011.

(51) Int. Cl.
*E21B 17/00* (2006.01)
*E21B 17/18* (2006.01)
(Continued)

(52) U.S. Cl.
CPC ..... *E21B 17/00* (2013.01); *E21B 17/18* (2013.01); *E21B 17/203* (2013.01); *E21B 34/06* (2013.01); *E21B 43/00* (2013.01); *E21B 43/10* (2013.01)

(58) Field of Classification Search
CPC ..... E21B 17/18; E21B 43/10; E21B 17/203
See application file for complete search history.

(56) References Cited

U.S. PATENT DOCUMENTS 2,335,578 A 11/1943 Carter
4,349,043 A 9/1982 Christensen
(Continued)

*Primary Examiner* — Nicole Coy
(74) *Attorney, Agent, or Firm* — ExxonMobil Upstream Research Company Law Dept.

(57) ABSTRACT

Systems and methods for managing pressures present in an annular space defined between casing strings contained within a subterranean well. These systems and methods may include providing a pressure distribution casing that includes a plurality of pressure distribution passages and distributing fluids present within the annular space along a length of the pressure distribution casing and/or between the annular space and the subterranean formation using a portion of the plurality of pressure distribution passages. Pressure distribution passages may be present on an inner surface of the pressure distribution casing, on an outer surface of the pressure distribution casing, and/or within a wall of the pressure distribution casing and may distribute the fluids along the length of the pressure distribution casing without distributing the fluids across and/or through a wall of the pressure distribution casing, such as between the inner surface and the outer surface of the pressure distribution casing.

15 Claims, 7 Drawing Sheets

(51) Int. Cl.

| | |
|---|---|
| ***E21B 43/00*** | (2006.01) |
| ***E21B 17/20*** | (2006.01) |
| ***E21B 43/10*** | (2006.01) |
| ***E21B 34/06*** | (2006.01) |

(56) References Cited

U.S. PATENT DOCUMENTS

| | | | | |
|---|---|---|---|---|
| 4,427,080 | A | 1/1984 | Steiger | |
| 4,662,442 | A | 5/1987 | Debreuille | |
| 5,425,598 | A | 6/1995 | Pennington | |
| 5,664,628 | A | 9/1997 | Koehler et al. | |
| 5,803,179 | A | 9/1998 | Echols et al. | |
| 5,881,809 | A | 3/1999 | Gillespie et al. | |
| 6,293,346 | B1 * | 9/2001 | Patel | 166/373 |
| 6,367,566 | B1 | 4/2002 | Hill | |
| 6,405,800 | B1 | 6/2002 | Walker et al. | |
| 6,494,265 | B2 | 12/2002 | Wilson et al. | |
| 6,557,634 | B2 | 5/2003 | Hailey, Jr. et al. | |
| 6,675,245 | B1 | 1/2004 | Schmidt | |
| 6,712,152 | B1 | 3/2004 | Yokley et al. | |
| 6,848,510 | B2 | 2/2005 | Bixenman et al. | |
| 7,191,830 | B2 * | 3/2007 | McVay et al. | 166/242.1 |
| 7,464,752 | B2 | 12/2008 | Dale et al. | |
| 7,637,318 | B2 | 12/2009 | Sierra et al. | |
| 7,735,559 | B2 | 6/2010 | Malone | |
| 7,735,935 | B2 | 6/2010 | Vinegar et al. | |
| 7,836,948 | B2 | 11/2010 | Kusko et al. | |
| 7,870,905 | B2 | 1/2011 | Hermes et al. | |
| 8,066,074 | B2 * | 11/2011 | Maskos et al. | 166/324 |
| 8,347,969 | B2 * | 1/2013 | Orr et al. | 166/373 |
| 2007/0114020 | A1 | 5/2007 | Brekke | |
| 2009/0159279 | A1 | 6/2009 | Assal | |
| 2009/0159298 | A1 | 6/2009 | Assal | |
| 2011/0005754 | A1 | 1/2011 | Daniels et al. | |

* cited by examiner

SYSTEMS AND METHODS FOR MANAGING PRESSURES IN CASING ANNULI OF SUBTERRANEAN WELLS

CROSS REFERENCE TO RELATED APPLICATIONS

This application is the National Stage of International Application No. PCT/US2011/063573, filed Dec. 6, 2011, which claims the benefit of U.S. Provisional Application 61/439,164, filed Feb. 3, 2011, the entirety of which is incorporated herein by reference for all purposes.

FIELD OF THE DISCLOSURE

The present disclosure is directed to systems and methods for distributing pressure differentials that may be present along a length of and/or within a casing contained within a subterranean well, and more particularly to systems and methods that provide and/or utilize a plurality of pressure distribution passages to distribute pressure differentials that may be present within a casing annulus and/or that may be present between the casing annulus and a subterranean formation.

BACKGROUND OF THE DISCLOSURE

Subterranean wells often include one or more enclosed and/or confined spaces, which may be defined within an annular space between one or more casing sections and/or casing strings and which may contain a variety of fluids. During the course of normal subterranean well operation, pressure within the annular space may vary significantly due to a number of factors, illustrative, non-exclusive examples of which may include the addition and/or removal of fluid from the annular space, changes in the chemical composition of the fluid contained within the annular space, a phase change of a portion of the fluid contained within the annular space, and/or a change in a temperature of the fluid contained within the annular space.

From time to time, pressure variations may result in a significant pressure buildup, or increase, within the annular space. Because subterranean wells may be designed to withstand a specific threshold pressure, pressure range, and/or pressure differential, the pressure buildup in the annular space may present a safety hazard to personnel and/or equipment in the vicinity of the subterranean well, decrease the service life of the subterranean well, and/or lead to failure of one or more components of the subterranean well. As an illustrative, non-exclusive example, one or more of the casing sections and/or casing strings contained within the subterranean well may burst and/or collapse due to this pressure buildup. As another illustrative, non-exclusive example, the structural integrity of other subterranean well components, such as seals, valves, and/or production trees may be compromised by this pressure buildup. As yet another illustrative, non-exclusive example, this pressure buildup may result in physical expansion, contraction, creep, and/or other motion(s) of subterranean well component(s), including vertical growth of the wellhead associated with the subterranean well.

Historically, pressure buildup within the annular space has been managed and/or controlled by such approaches as utilizing one or more of an open casing shoe, monitoring and bleeding of, or releasing, the pressure within the annular space, the use of a pressure relief device, and/or well killing and repair. An open casing shoe may be achieved when a subterranean well is constructed such that there is no seal preventing fluid flow between a terminal, or subsurface, end of a casing string and a portion of a subterranean formation that is proximal that end of the casing string. Thus, the pressure within the annular space at a given depth may be substantially equal to the pressure within the subterranean formation at the given depth. While this technique may be effective at decreasing the potential for pressure buildup within the annular space, this structure must be designed into the subterranean well during its construction and cannot readily be retrofit into existing subterranean wells. In addition, solids and fluids present within the annular space may form a particulate bridge within the annular space, and such a particulate bridge, or barrier, may decrease and/or eliminate the pressure distributing abilities of the open casing shoe. The use of an open casing shoe also precludes the ability to manage and/or control the pressure within the annular space relative to the pressure of the subterranean formation, which may be desirable under certain circumstances, such as to decrease the potential for a flow of fluid into the annular space.

Monitoring and bleeding of the pressure within the annular space may include manual and/or automated monitoring of the pressure within the annular space, together with manual and/or automated venting of the pressure within the annular space should the pressure increase above a target, or threshold, pressure. Monitoring and bleeding is most commonly achieved manually since many subterranean wells cannot be remotely monitored and controlled, making it a labor-intensive process. Since it is typically a manual process, monitoring and bleeding relies on the establishment of a periodic subterranean well inspection strategy, making it both expensive and prone to human error. In addition, and as discussed in more detail herein, particulate bridges may isolate a portion of the annular space, decreasing or eliminating the potential for fluid communication between the wellhead and the portion of the annular space and decreasing the effectiveness of monitoring and bleeding procedures to alleviate pressure buildup within the isolated portion of the annular space.

A pressure relief device may be utilized to automatically relieve annular space pressure if it increases above a predetermined and/or threshold pressure. This typically involves the use of pressure relief devices to relieve and/or equalize pressure in a radial direction, across a casing wall, as opposed to the longitudinal pressure relief techniques described herein. The pressure relief devices are typically built into the casing wall at specific points and often take the form of burst membranes, diaphragms, or other thin-walled portions of the casing that may burst, rupture, or otherwise open if a pressure differential across the pressure relief device increases above the threshold value. Since pressure relief devices are only located at discrete points within the casing wall, they also may be rendered ineffective by the presence of a particulate bridge, as discussed in more detail herein. In addition, since the pressure relief devices typically take the form of a burst membrane, they may be a single-use device that is not able to maintain a potentially desirable pressure differential within the annular space once the pressure relief device has been activated. Furthermore, the presence of the pressure relief device may decrease the overall structural integrity of the casing wall.

Well killing and repair may include any suitable activities adapted to eliminate a hazard associated with pressure buildup and bring the subterranean well back to a safe and functional operational status. These activities are typically invasive in nature, are often labor-intensive, and/or may require that the subterranean well be taken offline for a period of time while the killing and/or repair activities are completed.

While the above systems and methods to manage and/or control the pressure within the annular spaces of subterranean wells may be effective under certain circumstances, they also include a number of significant shortcomings, including those disclosed herein. In addition, several of the above systems and methods may not be practical in circumstances in which access to the wellhead and/or the annular space is restricted, such as may be the case with subsea wells. Thus, there exists a need for improved systems and methods for managing pressures in casing annuli of subterranean wells.

SUMMARY OF THE DISCLOSURE

The present disclosure is directed to systems and methods for managing pressures present in an annular space defined between casing strings contained within a subterranean well. These systems and methods may include providing a pressure distribution casing that includes at least a first pressure distribution passage, and which may include a plurality of pressure distribution passages, and distributing fluids present within the annular space along a length of the pressure distribution casing and/or between the annular space and the subterranean formation using a portion of the plurality of pressure distribution passages. The pressure distribution passages also may be referred to herein as passageways, fluid pathways, flow paths, and/or conduits and may include any suitable number and/or type of passage. As illustrative, non-exclusive examples, the pressure distribution passage(s) may include a single passage, a plurality of passages, and/or a maze of interconnected fluid passages, pathways, and/or flow paths. In addition, the pressure distribution passages may be present at any suitable location within the pressure distribution casing, including on an inner surface of the pressure distribution casing, on an outer surface of the pressure distribution casing, and/or within a wall of the pressure distribution casing and may distribute the fluids along the length of the pressure distribution casing without distributing the fluids across and/or through a wall of the pressure distribution casing, such as between the inner surface and the outer surface of the pressure distribution casing. In some embodiments, the pressure distribution casing may include a monolithic structure that defines a casing body of the pressure distribution casing and/or at least a portion of the plurality of pressure distribution passages. In some embodiments, the pressure distribution casing may include a composite structure that defines the casing body and/or at least a portion of the plurality of pressure distribution passages. In some embodiments, the pressure distribution passages may include discrete pressure distribution conduits. In some embodiments, the pressure distribution passages may include open and/or enclosed channels. In some embodiments, the pressure distribution passages may include a fluid-permeable coating, a packed bed, and/or foam. In some embodiments, the pressure distribution passages may include one or more flow control devices adapted to control a flow of fluid and/or other materials therethrough. In some embodiments, the pressure distribution passages may include a filler material, which in some embodiments may be a fluid filler material. Casing strings, wells, and methods of creating and using the same are also discussed.

DETAILED DESCRIPTION AND BEST MODE OF THE DISCLOSURE

Figure 1:
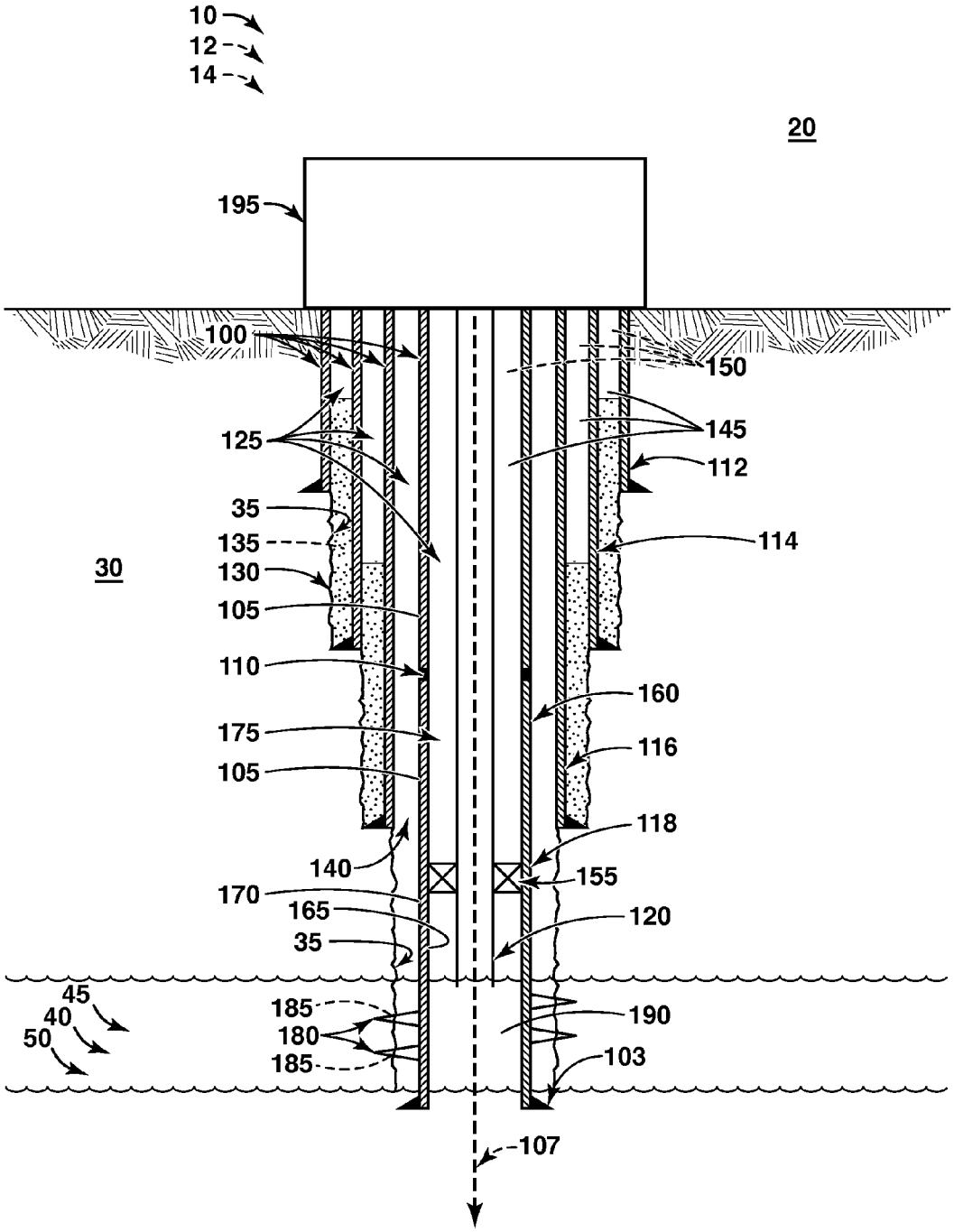
FIG. 1 is a schematic cross-sectional view of an illustrative, non-exclusive example of a subterranean well that includes a production control assembly, a plurality of casing strings, and a plurality of annular spaces that may be utilized with the systems and methods according to the present disclosure.

FIG. 1 provides a schematic cross-sectional view of an illustrative, non-exclusive example of a subterranean well 10, such as a hydrocarbon well 12 or an oil well 14, that may be utilized with the systems and methods according to the present disclosure. The subterranean well of FIG. 1 provides a hydraulic, or fluid, connection between a surface region 20 and a subsurface region 30 that includes a subterranean formation 40. Subterranean formation 40 includes a reservoir 45 that may contain or include a reservoir fluid 50, such as oil or another hydrocarbon.

Subterranean well 10 further includes a wellbore 35, which extends between the surface region and the subterranean formation, may provide a pathway for the movement of materials into and/or out of the subterranean well, and may contain one or more casing strings 100. Each of casing strings 100 may include one or more casing sections 105 that may be operatively attached to one another along a longitudinal axis 107 at a casing section joint 110 to form the casing string and may further include a casing shoe 103. Each of the plurality of casing sections includes a casing body 160 defining a casing body internal passage 175 and including a casing body inner surface 165 and a casing body outer surface 170.

When subterranean well 10 includes a plurality of casing strings, the casing strings may be aligned within one another in a coaxial, or generally coaxial, manner such as is schematically illustrated in FIG. 1. The plurality of casing strings 100 may include a conductor pipe 112, a surface casing string 114, one or more intermediate casing string(s) 116, and/or a production casing string 118. The coaxial alignment of the plurality of casing strings may create or define one or more annular spaces 125 between the casing strings.

A portion of the one or more annular spaces may include a hydraulic seal 130, such as cement 135, that may operatively attach the casing string to the wellbore, may isolate the annular space from fluid communication with the subsurface region, and/or may limit direct fluid communication between the annular space and the subsurface region. It is also within the scope of the present disclosure that a portion of the one or more annular spaces may not include a hydraulic seal that isolates the annular space from fluid communication with the subsurface region. Under these conditions, the outer casing string that defines the annular space may be referred to as an open shoe casing 140 that provides direct fluid communication between the annular space and the subsurface region. When the annular space includes hydraulic seal 130, the annular space also may be referred to as an enclosed or confined annular space 145, or simply an enclosed or confined space, and may contain a confined fluid 150. It is also within the scope of the present disclosure that an enclosed or confined annular space may be created through the use of a packer 155, which may locate production tubing 120 with respect to production casing string 118 or any other suitable casing string and create the enclosed annular space 145 between the production tubing and the casing string.

It is within the scope of the present disclosure that one or more of casing strings 100, such as production casing string 118, also may include fluid communication points 180 that may provide fluid communication between an internal passage 190 of the casing string and subterranean formation 40. Fluid communication points 180 may additionally or alternatively be referred to herein as subterranean communication ports, subterranean communication regions, subterranean perforations, and/or subterranean communication zones. The fluid communication points may provide fluid communication between the surface region and various portions of the subterranean formation via any suitable mechanism or structure, including apertures, perforations or perforated regions 185, flow control devices, and the like. It is also within the scope of the present disclosure that subterranean well 10 may further include production control assembly 195 that may control the transfer of fluid into and/or out of subterranean well 10.

Figure 2:
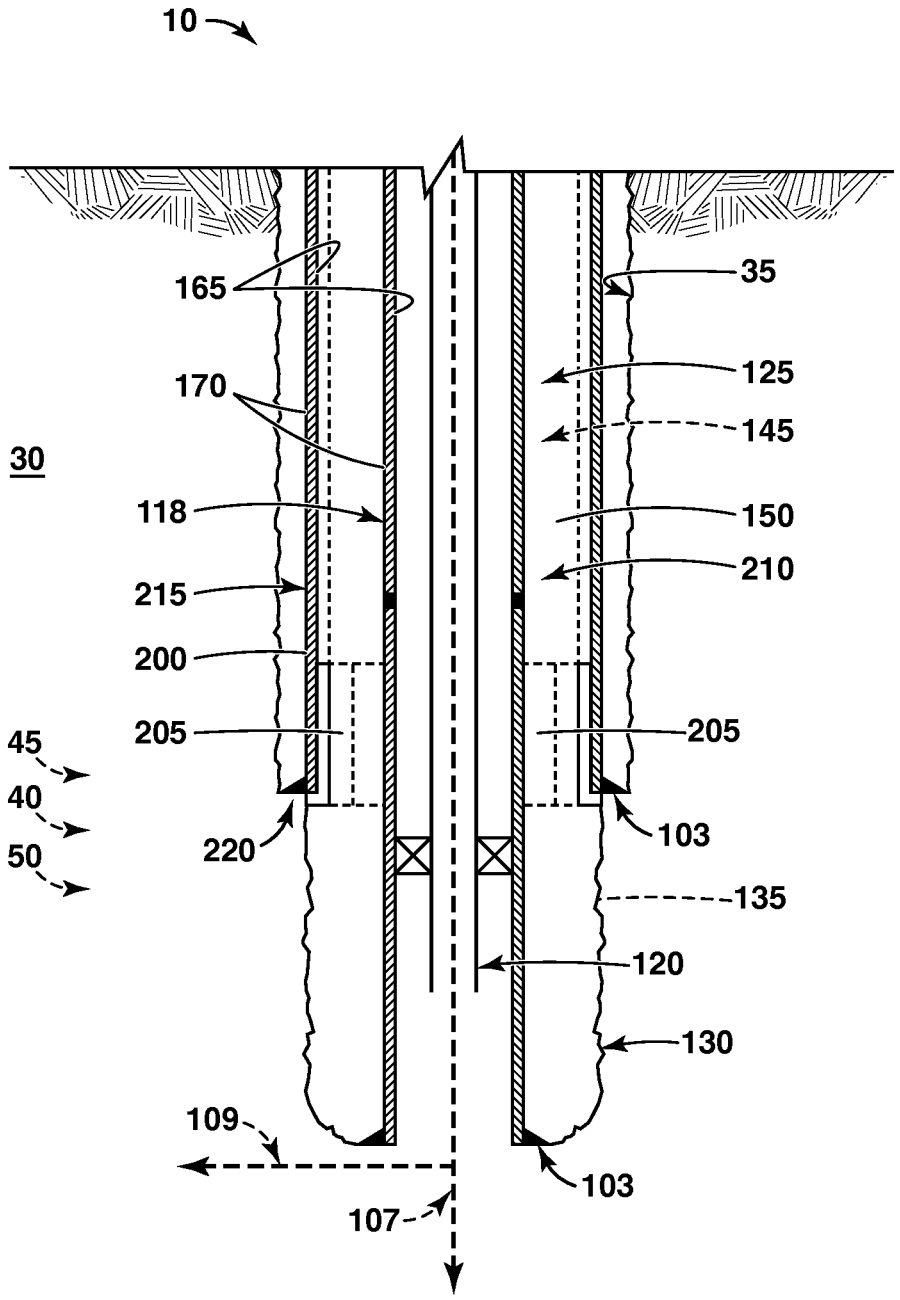
FIG. 2 is a fragmentary cross-sectional view of an illustrative, non-exclusive example of a pressure distribution casing according to the present disclosure.

In addition to any of the illustrative, non-exclusive examples of subterranean well components shown in FIG. 1, subterranean wells according to the present disclosure further include a pressure distribution casing 200 as shown in FIG. 2. The pressure distribution casing of FIG. 2 includes at least a first pressure distribution passage 205, and may include a plurality of pressure distribution passages 205, which also may be referred to as a plurality of passageways, a plurality of fluid pathways, a plurality of flow paths, a plurality of fluid flow paths, a maze of passageways, a maze of fluid pathways, a maze of flow paths, a maze of fluid flow paths, and/or a maze of pressure distribution passages. Although not required to all embodiments, it is within the scope of the present disclosure that pressure distribution passages disclosed herein may include tortuous pressure distribution passages. As used herein, "maze" may refer to any suitable collection and/or network of interconnecting and/or winding paths, passages, pathways, passageways, and/or conduits.

The use of pressure distribution casing 200 that includes a plurality of pressure distribution passages 205 and/or a maze of flow paths may provide a pressure distribution structure that may distribute and/or vent trapped annular pressure 210 and/or confined fluid 150 without reducing the mechanical integrity of the casing string. In addition, the inclusion of a plurality of pressure distribution passages may decrease the likelihood that a particulate bridge, or barrier, may form that blocks, or obstructs, a substantial portion and/or all of the plurality of pressure distribution passages and may increase the effectiveness of the overall pressure distribution structure. As an illustrative, non-exclusive example, since pressure distribution casing 200 includes a plurality of pressure distribution passages 205, if one or more of the plurality of pressure distribution passages is blocked, occluded, or otherwise obstructed, the additional pressure distribution passages may still distribute and/or vent the trapped annular pressure.

In FIG. 2, hydraulic seal 130, such as cement 135, forms a seal between production casing string 118 and pressure distribution casing string 215; and pressure distribution passages 205 are adapted to distribute annular pressure 210 that may be generated by confined fluid 150 within confined annular space 145 and/or between the confined annular space and subsurface region 30. Subsurface region 30 may include subterranean formation 40, which may include reservoir 45 containing reservoir fluid 50. This distribution of annular pressure may include distributing annular pressure along a surface of the pressure distribution casing, such as inner surface 165 and/or outer surface 170.

Pressure distribution casing string 215 includes at least one pressure distribution casing 200 and may include any suitable number of pressure distribution casings, as well as any suitable number of casing sections that do not include pressure distribution passages 205. As used herein, a reference to pressure distribution casing 200 may additionally or alternatively be considered to be a reference to pressure distribution casing string 215 since the pressure distribution casing string includes at least a first pressure distribution casing 200.

Pressure distribution passages 205 may include any suitable size, shape, characteristic cross-sectional dimension, number of passages, and/or configuration that may distribute annular pressure 210 along at least a portion of the length of pressure distribution casing string 215 (or in a direction that is, or is generally, parallel to longitudinal axis 107), between a terminal end 220 of the pressure distribution casing string and the subsurface region, between another portion of the pressure distribution casing string and the subsurface region, and/or between the annular space and the surface region. Thus, pressure distribution passages 205 are shown in dotted lines in FIG. 2 to illustrate that the pressure distribution passages may be present only at terminal end 220 of pressure distribution casing 200, along a portion of the length of the pressure distribution casing 200, or along the entire length of the pressure distribution casing 200. As also shown in dotted lines, it is within the scope of the present disclosure that pressure distribution passages 205 may have any suitable thickness in the direction of radial axis 109 of the pressure distribution casing. Illustrative, non-exclusive examples of pressure distribution passage cross-sectional shapes according to the present disclosure include square, triangular, rectangular, circular, pentagonal, oval, polygonal, concentric annular, and/or eccentric annular.

It is within the scope of the present disclosure that, while pressure distribution passages 205 may distribute annular pressure 210 along the length of the pressure distribution casing string, they may not, or may not be configured to, distribute the annular pressure through the casing (i.e., between the casing body inner surface and the casing body outer surface). Thus, the systems and methods disclosed herein may be adapted to distribute annular pressure 210 in a direction that is generally parallel to longitudinal axis 107 of the pressure distribution casing string but not in a direction that is generally parallel to radial axis 109 of the pressure distribution casing string.

As an illustrative, non-exclusive example, it is within the scope of the present disclosure that the plurality of pressure distribution passages 205 may extend over at least 1% of a surface area of an individual pressure distribution casing, including pressure distribution passages 205 that extend over at least 5%, at least 10%, at least 25%, at least 50%, at least 75%, or 100% of the surface area of the individual pressure distribution casing, or over a similar percentage of a surface area of the pressure distribution casing string. As used herein, a surface area of the individual pressure distribution casing may include the inner casing body surface, the outer casing body surface, or both the inner casing body surface and the outer casing body surface.

As another illustrative, non-exclusive example, it is also within the scope of the present disclosure that the plurality of pressure distribution passages 205 may extend over at least 1% of a length of the individual pressure distribution casing. This may include pressure distribution passages 205 that extend over at least 5%, at least 10%, at least 25%, at least 50%, at least 75%, or 100% of the length of the individual pressure distribution casing, or over a similar percentage of a length of the pressure distribution casing string.

As another illustrative, non-exclusive example, and as discussed herein, pressure distribution passages 205 may include any suitable thickness in the direction of radial axis 109 of the pressure distribution casing string, up to and including the thickness of the annular space in the direction of the radial axis. This may include pressure distribution thicknesses of less than 1% of the thickness of the annular space, as well as thicknesses that are greater than 1% of the thicknesses of the annular space, including thicknesses of greater than 5%, greater than 10%, greater than 20%, greater than 25%, greater than 50%, greater than 75%, or thicknesses of 100% of the thickness of the annular space in the direction of radial axis 109.

As used herein, characteristic cross-sectional dimensions may include any suitable measure of the cross-sectional dimension and/or the cross-sectional area for fluid flow through the pressure distribution passages. As an illustrative, non-exclusive example, when the pressure distribution passages include a circular or near-circular cross-sectional shape, the characteristic cross-sectional dimension may include a characteristic, average, mean, or median radius or diameter of the pressure distribution passages. As another illustrative, non-exclusive example, when the pressure distribution passages do not include a circular or near-circular cross-sectional shape, the characteristic cross-sectional dimension may include an equivalent radius or diameter, such as the diameter of a circle of equivalent cross-sectional area to the cross-sectional area of the characteristic, average, mean, or median pressure distribution passage.

The individual pressure distribution passages may include any suitable characteristic cross-sectional dimension. As an illustrative, non-exclusive example, this may include cross-sectional dimensions that are less than 3.0 cm, including cross-sectional dimensions of less than 2.5 cm, less than 2.0 cm, less than 1.5 cm, less than 1.0 cm, less than 0.9 cm, less than 0.8 cm, less than 0.7 cm, less than 0.6 cm, less than 0.5 cm, less than 0.4 cm, less than 0.3 cm, less than 0.2 cm, less than 0.1 cm, between 0.1 and 0.2 cm, between 0.1 and 0.3 cm, between 0.1 and 0.5 cm, between 0.5 and 1.0 cm, and between 1.0 and 3.0 cm, as well as characteristic cross-sectional dimensions that are greater than 3 cm.

As another illustrative, non-exclusive example, it is within the scope of the present disclosure that the characteristic dimension of the plurality of pressure distribution passages may be less than 20% of a characteristic cross-sectional dimension of the pressure distribution casing with which they are associated. This may include characteristic dimensions of the plurality of hydraulic pathways that are less than 15%, less than 10%, less than 5%, or less than 1% of the characteristic cross-sectional dimension of the pressure distribution casing.

As yet another illustrative, non-exclusive example, it is within the scope of the present disclosure that the characteristic dimension of the plurality of pressure distribution passages may be less than 75% of a characteristic wall thickness of the pressure distribution casing with which they are associated. This may include characteristic dimensions that are less than 50%, less than 25%, less than 10%, or less than 5% of the characteristic wall thickness of the pressure distribution casing.

It is also within the scope of the present disclosure that pressure distribution casing 200 may include any suitable number of pressure distribution passages 205 at a given transverse cross-sectional location. As an illustrative, non-exclusive example, the pressure distribution casing may include more than 2 pressure distribution passages, including more than 5, more than 10, more than 25, more than 50, more than 75, more than 100, or more than 250 pressure distribution passages. In addition, these pressure distribution passages may be present at any suitable location and/or on any suitable surface of the pressure distribution casing. Moreover, the pressure distribution passages may be discontinuous, perforated, interconnected, divergent, convergent, intersecting, etc., as discussed herein. This is shown schematically in FIG. 3.

Figure 3:
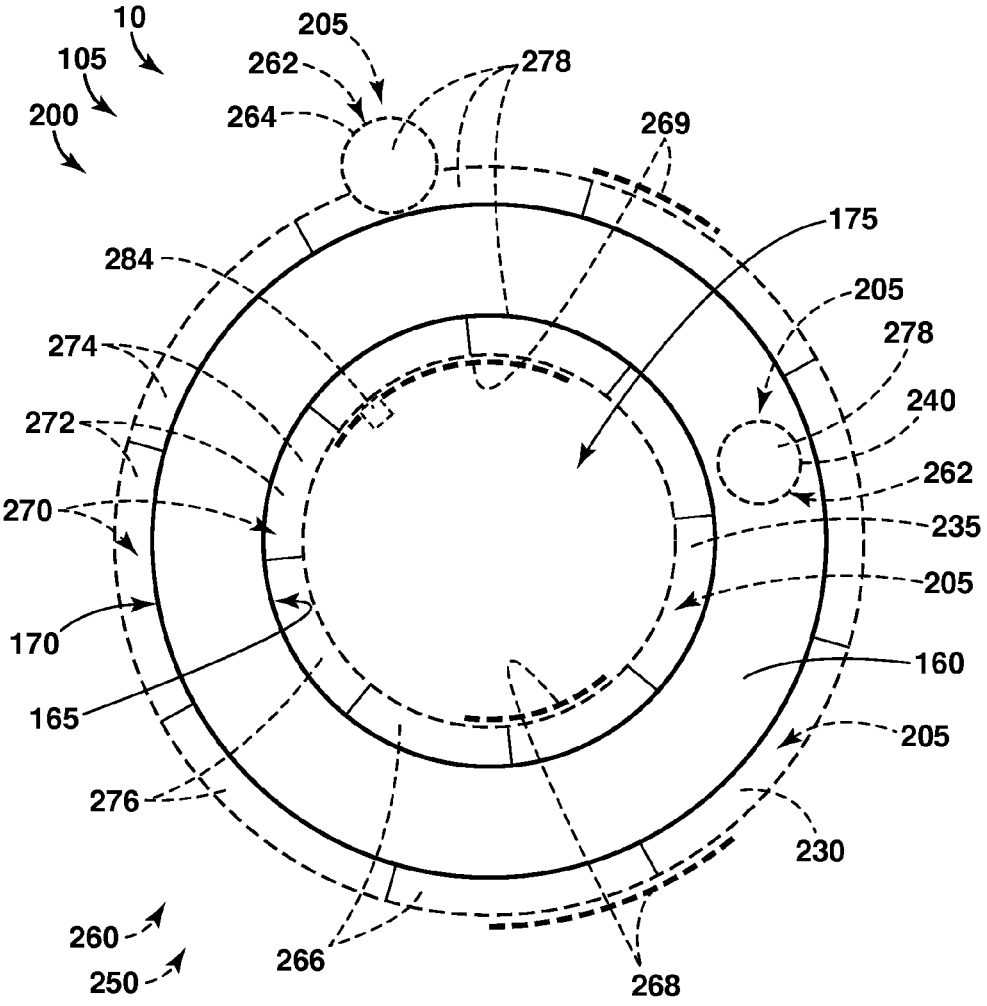
FIG. 3 is a transverse cross-sectional view of an illustrative, non-exclusive example of a pressure distribution casing including a plurality of optional pressure distribution passages and passage locations according to the present disclosure.

Pressure distribution casing 200 of FIG. 3 includes casing body 160 defined between casing body inner surface 165 and casing body outer surface 170. As shown in FIG. 3, it is within the scope of the present disclosure that pressure distribution passages 205 may be located at any suitable location and/or on any suitable surface of pressure distribution casing 200. This may include pressure distribution passages that are located on and/or associated with the casing body outer surface as indicated at 230, pressure distribution passages that are located on and/or associated with the casing body inner surface as indicated at 235, and/or pressure distribution passages that are located within and/or associated with the casing body as indicated at 240. As discussed in more detail herein, the pressure distribution passages may include any suitable method and/or materials of construction and may include any suitable orientation, cross-sectional shape, and/or configuration.

It is within the scope of the present disclosure that pressure distribution casing 200 may include, and/or form, a monolithic structure 250 that defines casing body 160, casing body internal passage 175, and/or a portion of the plurality of pressure distribution passages 205. When pressure distribution casing 200 includes a monolithic structure, the monolithic structure may be formed by any suitable manufacturing method, illustrative, non-exclusive examples of which may include extrusion, seamed and/or seamless pipe manufacturing techniques such as forming and welding or rolling and piercing, and/or material removal techniques that form the internal passage and/or a portion of the plurality of pressure distribution passages by removing a portion of the material that comprises the casing body. Illustrative, non-exclusive examples of material removal techniques according to the present disclosure may include any suitable milling, machining, drilling, sanding, punching, scratching, scraping, knurling, mechanical abrasion, electric discharge machining, and/or water discharge machining technique.

It is also within the scope of the present disclosure that pressure distribution casing 200 may include a composite structure 260 including two or more components and/or materials that define casing body 160, casing body internal passage 175, and/or a portion of the plurality of pressure distribution passages. When pressure distribution casing 200 includes a composite structure, the composite structure may be formed by any suitable method. As an illustrative, non-exclusive example, at least one of the casing body internal passage and a portion of the plurality of pressure distribution passages may be formed by the inclusion of a discrete fluid passage 262 within the casing body. This may include inserting the discrete fluid passage into the casing body and/or forming, creating, molding, or extruding the casing body around the discrete fluid passage. As another illustrative, non-exclusive example, a portion of the plurality of pressure distribution passages may include one or more discrete fluid passages 262 that may be operatively attached to the casing body as indicated at 264. This may include at least a first discrete pressure distribution passage that is operatively attached to the casing body using any suitable attaching mechanism, illustrative, non-exclusive examples of which may include any suitable fixture, fastener, clasp, adhesive, weld, braze, bond, or threads.

As another illustrative, non-exclusive example, and as shown schematically in FIG. 3, casing body inner surface 165 and/or casing body outer surface 170 may be coated or covered with a fluid-permeable coating 266 that may form a portion of the plurality of pressure distribution passages. Illustrative, non-exclusive examples of fluid-permeable coatings according to the present disclosure may include any suitable porous foam, porous polymer, sintered material, and/or packed bed. It is within the scope of the present disclosure that at least a portion of the fluid-permeable coating may be covered by a fluid-permeable layer 268 that may protect the fluid-permeable coating, increase the structural integrity of the fluid-permeable coating, increase the durability of the fluid-permeable coating, and/or restrict the entry of fluids into the fluid-permeable coating. As an illustrative, non-exclusive example, the fluid-permeable coating may include an average pore size and/or average pressure distribution passage size that may define a minimum particulate size that may freely flow therethrough. It is within the scope of the present disclosure that fluid-permeable layer 268 may restrict the flow of particulate matter that is larger than the minimum particulate size therethrough, thereby decreasing the potential for plugging, clogging, and/or occlusion of the pores and/or pressure distribution passages contained within fluid-permeable coating 266.

It is also within the scope of the present disclosure that at least a portion of the fluid-permeable coating may be covered by a fluid-impermeable layer 269 that may limit, restrict, and/or stop the flow of fluid the therethrough, protect the fluid-permeable coating, increase the structural integrity of the fluid-permeable coating, and/or increase the durability of the fluid-permeable coating. It is also within the scope of the present disclosure that the fluid-impermeable layer may include discontinuities, openings, and/or holes 284 that may provide a path for fluid to pass into, out of, and/or through the fluid-permeable coating. These discontinuities may be randomly and/or systematically located. As an illustrative, non-exclusive example, these discontinuities may be substantially uniformly distributed across a surface of the fluid-impermeable coating. As another illustrative, non-exclusive example, these discontinuities may be concentrated in certain portions of the surface of the fluid-impermeable coating.

It is within the scope of the present disclosure that pressure distribution passages 205 may include pressure distribution channels 270 formed on and/or in a surface of casing body 160. These channels may be formed by any suitable method, including the techniques for forming both monolithic and composite pressure distribution casings disclosed herein and may include open channels 272 and/or enclosed channels 274. As used herein, open channels refer to channels that do not form or include an enclosed space when viewed in transverse cross-section. As used herein, enclosed channels include open channels that include a covering over at least a portion of the channel such that the portion of the channel forms or includes an enclosed space when viewed in transverse cross-section.

It is also within the scope of the present disclosure that a portion of the plurality of pressure distribution passages 205 may include a porous material 276 contained within at least a portion of the annular space defined by and/or between the passages. As discussed in more detail herein with reference to the pressure distribution passages of FIG. 2, this porous material may include any suitable portion of the annular space, including some but not all of the annular space or even all of the annular space. Illustrative, non-exclusive examples of porous materials according to the present disclosure include a packed bed, a sintered material, and/or a porous foam.

It is within the scope of the present disclosure that pressure distribution passages 205 may include and/or contain a filler material 278. The filler material may be contained within at least a portion of one or more of the plurality of pressure distribution passages 205 and may serve to block, occlude, restrict, and/or filter the flow of fluid and/or particulate material therethrough.

As an illustrative, non-exclusive example, filler material 278 may block the flow of fluid and/or particulate material into pressure distribution passages 205, such as to block the flow while pressure distribution casing 200 is being installed into wellbore 35. As a further illustrative, non-exclusive example, filler material 278 may include a suitable meltable solid, such as a wax or ice, and/or a soluble solid, such as a water-soluble polymer and/or an oil-soluble polymer that may be adapted to occlude the flow of material into pressure distribution passages 205 while pressure distribution casing 200 is being installed into wellbore 35 but may be adapted to melt, dissolve, or otherwise be removed from the pressure distribution passages once pressure distribution casing 200 has been installed into wellbore 35. As another illustrative, non-exclusive example, filler material 278 may include a suitable fluid-permeable solid, such as a suitable foam, sintered material, and/or packed bed that may be adapted to enable the flow of some materials, such as fluids, through pressure distribution passage 205 but obstruct the flow of other materials, such as particulates larger than a threshold size, into the pressure distribution passage.

As yet another illustrative, non-exclusive example, filler material 278 may include a fluid, such as a liquid and/or a gas. Additionally or alternatively, it is within the scope of the present disclosure that filler material 278, when present, may include an expanding filler material, such as an expanding filler material that expands as pressure distribution casing 200 is inserted into wellbore 35. As an illustrative, non-exclusive example, the inclusion of such an expanding filler material may decrease the potential for drilling fluid, drilling and/or other particulate, cement, debris, and/or other materials to enter at least a portion of the plurality of pressure distribution passages 205. Moreover, as the expandable filler material expands, it may remove any such material that has entered the plurality of pressure distribution passages. As an illustrative, non-exclusive example, this expanding material may expand with natural temperature increases as a portion of the pressure distribution casing including the expanding filler material is inserted deeper into the wellbore, may expand with natural pressure increases as the portion of the pressure distribution casing including the expanding filler material is inserted deeper into the wellbore, and/or may expand with temperature and/or pressure changes that are produced through the introduction and/or removal of material from subterranean well 10.

As yet another illustrative, non-exclusive example, it is within the scope of the present disclosure that filler material 278, when present, may include any suitable fluid, illustrative, non-exclusive examples of which include carbon dioxide, water, aqueous salt solutions, including salt solutions of calcium carbonate and/or potassium chloride, and/or non-aqueous solutions. It is within the scope of the present disclosure that filler material 278 may be selected based upon any suitable selection criteria, illustrative, non-exclusive examples of which include any suitable parameter and/or characteristic of the pressure distribution conduit, the pressure distribution passages, the subterranean well, the subterranean formation, the reservoir, and/or the reservoir fluid. Illustrative, non-exclusive examples of selection criteria according to the present disclosure include any suitable temperature, pressure, viscosity, density, thermal expansion coefficient, vapor pressure, characteristic dimension, surface energy, diffusion coefficient, and/or permeability. It is also within the scope of the present disclosure that a portion of the plurality of pressure distribution passages 205 may include an evacuated space.

As discussed in more detail herein, pressure distribution passages 205 according to the present disclosure may include any suitable orientation and/or configuration and may provide fluid flow in any direction suitable to provide a desired level, magnitude, and/or direction of pressure distribution. Thus, while several of the pressure distribution passages disclosed herein are illustrated as being aligned with and/or providing fluid flow and/or pressure distribution in a direction that is generally parallel to the longitudinal axis of the pressure distribution casing, this presentation has been depicted for ease of illustration, and any suitable pressure distribution passage 205 orientation, fluid flow direction, and/or pressure distribution direction is within the scope of the present disclosure. This may include pressure distribution passage orientations, fluid flow directions, and/or pressure distribution directions that are generally parallel to, perpendicular to, at a skew angle to, and/or tangential to any suitable surface and/or axis of the pressure distribution casing. In addition, while an average, bulk, mean, or resultant fluid flow or pressure distribution may be in a particular direction, it is within the scope of the present disclosure that the orientation of the individual pressure distribution passages 205 that provide for the fluid flow may not be, or at least may not consistently be, oriented in the same direction. As an illustrative, non-exclusive example, pressure distribution passages 205 may be oriented randomly on casing body inner surface 165 as shown in FIG. 3. However, despite the random orientation of the pressure distribution passages, the average, bulk, mean, or resultant flow of fluid within the pressure distribution passages may be in a direction that is generally parallel to the longitudinal axis of the pressure distribution casing.

FIGS. 4-15 provide schematic side views of illustrative, non-exclusive examples of pressure distribution casings 200 that include pressure distribution passages 205 according to the present disclosure. In FIGS. 4-15, the pressure distribution passages are shown positioned along a portion of the casing body. It is within the scope of the present disclosure that this portion may be the casing body outer surface or the casing body inner surface. It is also within the scope of the present disclosure that the pressure distribution passages may additionally and/or alternatively be positioned and/or otherwise extend within the casing body, and that the pressure distribution passages may be in fluid communication with either the casing body inner surface or the casing body outer surface.

In general, FIGS. 4-15 illustrate that pressure distribution passages 205 of pressure distribution casings 200 and/or casing sections 105 according to the present disclosure may be continuous or discontinuous, both within an individual pressure distribution casing and/or between two adjacent pressure distribution casings that are operatively attached to one another by a casing section joint, may be at any suitable angle and/or orientation with respect to the longitudinal axis of the pressure distribution casing, may be aligned systematically and/or randomly, may form a linear and/or a tortuous flow path, may be symmetrical and/or asymmetrical, may intersect with other pressure distribution passages, and/or may split and/or fork.

Figure 4:
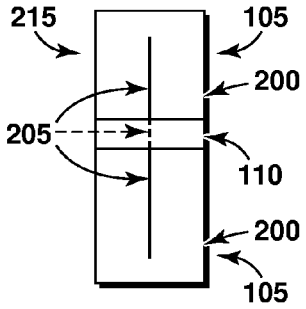
FIG. 4 is a schematic side view of an illustrative, non-exclusive example of a pressure distribution casing string including two pressure distribution casings and a casing section joint according to the present disclosure, wherein the pressure distribution passage may be continuous or discontinuous across the casing section joint.
Figure 5:
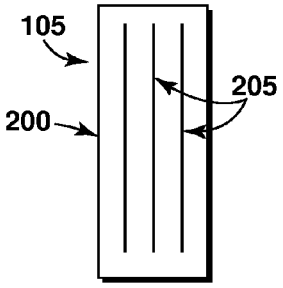
FIG. 5 is a schematic side view of an illustrative, non-exclusive example of a pressure distribution casing according to the present disclosure that includes a plurality of continuous, longitudinal pressure distribution passages.

FIG. 4 illustrates two casing sections 105, both including pressure distribution casings 200, that are operatively attached to one another at casing section joint 110. Each of the pressure distribution casings includes a single, continuous pressure distribution passage 205 that is aligned in parallel with the longitudinal axis of the pressure distribution casing. As shown by the dashed lines in FIG. 4, it is within the scope of the present disclosure that pressure distribution passages 205 may be continuous from one pressure distribution casing to the next pressure distribution casing and/or that the pressure distribution passages may be discontinuous from one pressure distribution casing to the next. It is also within the scope of the present disclosure that pressure distribution passages within a single or connected pressure distribution casing and/or extending in fluid communication between two or more pressure distribution casings may extend in other relative angular orientations to the longitudinal axis of the corresponding pressure distribution casing(s). The pressure distribution casing of FIG. 5 is substantially similar to the individual pressure distribution casings of FIG. 4 except that it includes a plurality of parallel pressure distribution passages.

Figure 6:
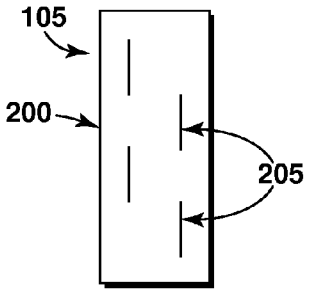
FIG. 6 is another schematic side view of an illustrative, non-exclusive example of a pressure distribution casing according to the present disclosure that includes a single, discontinuous, staggered, longitudinal pressure distribution passage.
Figure 8:
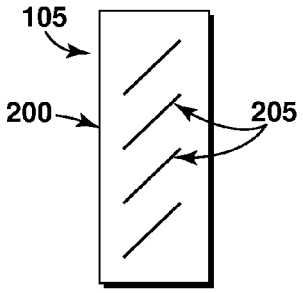
FIG. 8 is another schematic side view of an illustrative, non-exclusive example of a pressure distribution casing according to the present disclosure that includes a discontinuous, staggered, skew pressure distribution passage.
Figure 7:
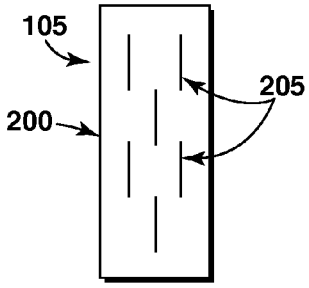
FIG. 7 is another schematic side view of an illustrative, non-exclusive example of a pressure distribution casing according to the present disclosure that includes a plurality of discontinuous, staggered, longitudinal pressure distribution passages.
Figure 9:
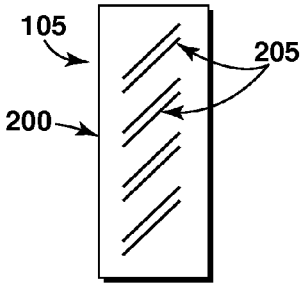
FIG. 9 is another schematic side view of an illustrative, non-exclusive example of a pressure distribution casing according to the present disclosure that includes a plurality of discontinuous, staggered, skew pressure distribution passages.
Figure 10:
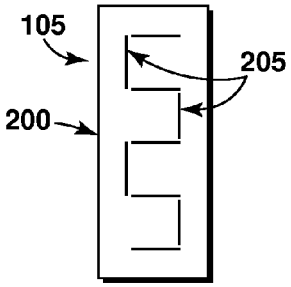
FIG. 10 is another schematic side view of an illustrative, non-exclusive example of a pressure distribution casing according to the present disclosure that includes a discontinuous, longitudinal and transverse pressure distribution passage.
Figure 11:
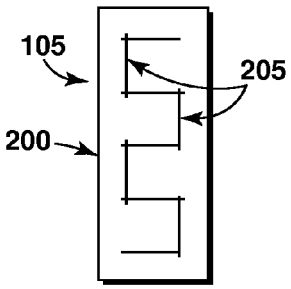
FIG. 11 is another schematic side view of an illustrative, non-exclusive example of a pressure distribution casing according to the present disclosure that includes a continuous, longitudinal and transverse pressure distribution passage.

FIGS. 6 and 7 illustrate that pressure distribution passages 205 according to the present disclosure may be discontinuous along a length of the pressure distribution casing and may include single and/or multiple staggered, symmetrical pressure distribution passages. In FIGS. 8 and 9, single and multiple staggered, asymmetrical pressure distribution passages that are oriented at a skew angle (i.e., are not parallel to the longitudinal axis of the pressure distribution casing) with respect to the longitudinal axis of the pressure distribution casing are shown. In FIGS. 10 and 11, both continuous and discontinuous pressure distribution passages that form tortuous flow paths and include flow in a direction that is parallel to the longitudinal axis of the pressure distribution casing, as well as flow in a direction that is perpendicular to the longitudinal axis of the pressure distribution casing are shown.

Figure 12:
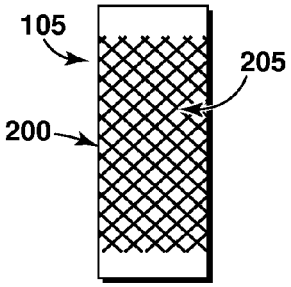
FIG. 12 is another schematic side view of an illustrative, non-exclusive example of a pressure distribution casing according to the present disclosure that includes a plurality of skew, cross-hatched pressure distribution passages.
Figure 14:
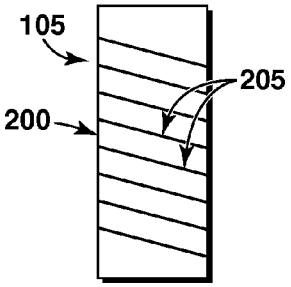
FIG. 14 is another schematic side view of an illustrative, non-exclusive example of a pressure distribution casing according to the present disclosure that includes at least one continuous, helical pressure distribution passage.
Figure 13:
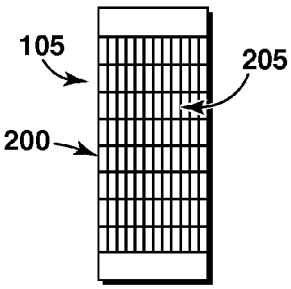
FIG. 13 is another schematic side view of an illustrative, non-exclusive example of a pressure distribution casing according to the present disclosure that includes a plurality of longitudinal and transverse, knurled pressure distribution passages.
Figure 15:
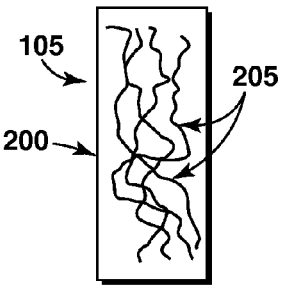
FIG. 15 is another schematic side view of an illustrative, non-exclusive example of a pressure distribution casing according to the present disclosure that includes a plurality of tortuous pressure distribution passages.

FIGS. 12 and 13 illustrate systematic, intersecting patterns for pressure distribution passages according to the present disclosure, including the diamond-shaped, intersecting, cross-hatched pattern of FIG. 12 and the square-shaped, intersecting, cross-hatched pattern of FIG. 13. In FIG. 14, a continuous, spiral or helical orientation in which the pressure distribution passages are arranged in an orientation that is tangential to the casing body outer surface is shown. FIG. 15 illustrates a random collection of individual, intersecting, and/or forking pressure distribution passages that may define a plurality of tortuous flow paths. While many of the pressure distribution passages illustrated in FIGS. 4-15 are shown aligned along a longitudinal axis of pressure distribution casing 200, it is within the scope of the present disclosure that these pressure distribution passages may include any suitable orientation with respect to the pressure distribution casing. As an illustrative, non-exclusive example, any of the pressure distribution passages disclosed herein may be aligned tangentially and/or circumferentially along a surface of the pressure distribution casing, may be aligned at a skew angle relative to the longitudinal axis of the pressure distribution casing, and/or may include portions that extend in different angular orientations relative to the long axis of the pressure distribution casing.

Figure 16:
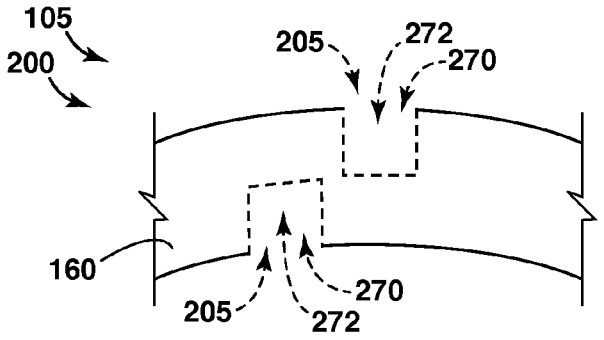
FIG. 16 is a partial transverse schematic cross-sectional view of a pressure distribution casing that includes one or more pressure distribution passages according to the present disclosure, wherein the pressure distribution passages form an open groove or channel on a surface of the pressure distribution casing.
Figure 17:
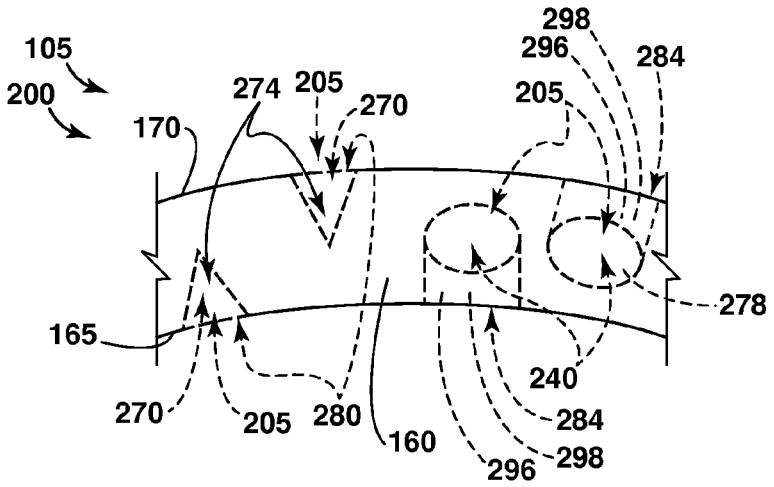
FIG. 17 is another partial transverse schematic cross-sectional view of a pressure distribution casing that includes a plurality of pressure distribution passages according to the present disclosure, wherein the pressure distribution passages form covered channels and/or passages that are internal to the casing body wall.

FIGS. 16-21 provide less schematic but still illustrative, non-exclusive examples of transverse cross-sections of casing sections 105 including pressure distribution casings 200 with pressure distribution passages 205 according to the present disclosure. FIG. 16 illustrates open channels 272, while FIG. 17 illustrates enclosed channels 274 that include an optional cover 280 over at least a portion of the channel. FIG. 17 further illustrates pressure distribution passages that may be contained within the casing body wall at 240. As also shown in FIG. 17, any of the plurality of pressure distribution passages 205 may include one or more openings 284 that may serve as fluid inlets 296 and/or fluid outlets 298 and may be associated with casing body inner surface 165 or casing body outer surface 170, but not both the casing body inner surface and the casing body outer surface. In addition, FIG. 17 also illustrates that any of the pressure distribution passages optionally may include filler material 278 without departing from the scope of the present disclosure.

Figure 18:
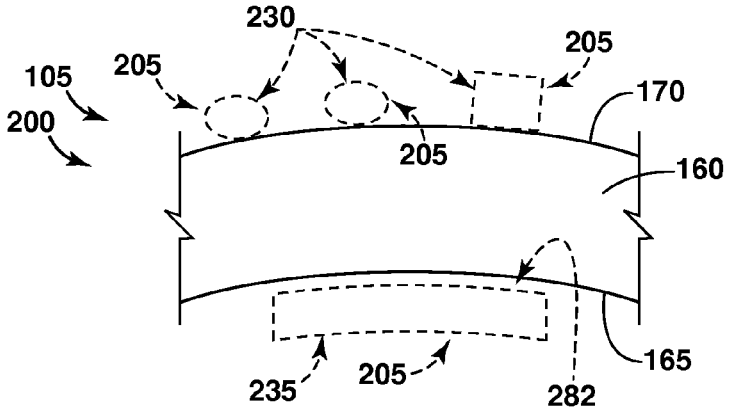
FIG. 18 is another partial transverse schematic cross-sectional view of a pressure distribution casing that includes a plurality of pressure distribution passages according to the present disclosure, wherein the pressure distribution passages are attached to an inner surface and/or an outer surface of the pressure distribution casing.

FIG. 18 illustrates a plurality of pressure distribution passages 205 that may be operatively attached to the casing body outer surface at 230 and/or the casing body inner surface at 235. When the pressure distribution passages are operatively attached to a casing body surface, they may be attached using an attachment mechanism 282, which may include any of the illustrative, non-exclusive examples of attaching mechanisms disclosed herein.

Figure 19:
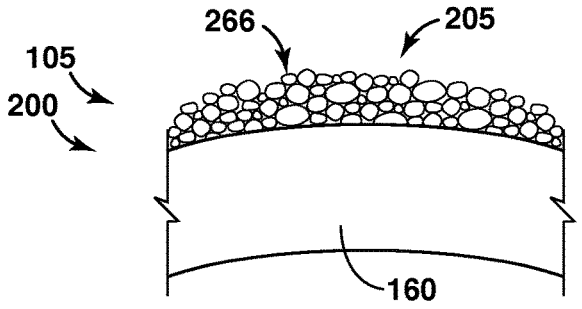
FIG. 19 is another partial transverse schematic cross-sectional view of a pressure distribution casing according to the present disclosure, wherein the plurality of pressure distribution passages includes a porous coating with a fluid-permeable outer surface that forms a plurality of tortuous pressure distribution passages.
Figure 20:
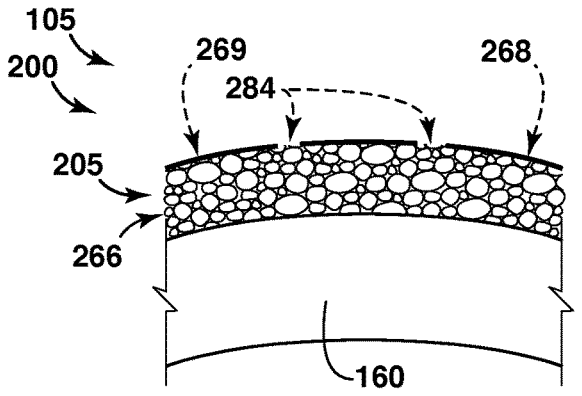
FIG. 20 is another partial transverse schematic cross-sectional view of a pressure distribution casing according to the present disclosure, wherein the pressure distribution casing includes a porous coating that forms a plurality of tortuous pressure distribution passages and further wherein the pressure distribution casing also includes a selectively fluid-permeable outer layer.
Figure 21:
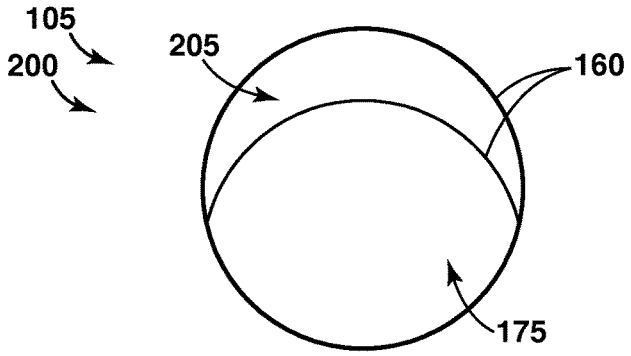
FIG. 21 is another transverse schematic cross-sectional view of a pressure distribution casing according to the present disclosure, wherein the pressure distribution casing includes an internal passage and at least a first pressure distribution passage formed from an eccentric annular structure.

In FIG. 19, pressure distribution passages 205 take the form of fluid-permeable coating 266, while, in FIG. 20, fluid-permeable coating 266 is covered by a layer, such as fluid-permeable layer 268 and/or fluid-impermeable layer 269. The layer may include openings 284 that may enable the flow of fluid into and/or out of fluid-permeable coating 266. FIG. 21 provides yet another illustrative, non-exclusive example of pressure distribution casing 200 according to the present disclosure. In FIG. 21, the pressure distribution casing includes an eccentric annular structure and pressure distribution passage 205 may include the crescent-shaped passage of the eccentric annular structure.

As discussed in more detail herein and shown schematically in FIGS. 16-21, pressure distribution passages 205 according to the present disclosure may include any suitable shape, location, and/or configuration, including the shapes, locations, and/or configurations disclosed herein, as well as other shapes, locations, and/or configurations. It is also within the scope of the present disclosure that pressure distribution passages 205 may include any suitable combination of shapes, locations, and/or configurations, including any suitable combination of the shapes, locations, and/or configurations shown in FIGS. 16-21. As an illustrative, non-exclusive example, pressure distribution casing 200 may include different pressure distribution passages 205 on and/or associated with the casing body inner surface than those on or associated with the casing body outer surface. As a more specific, but still illustrative, non-exclusive, example, this may include pressure distribution casings that include the fluid-permeable coating of FIG. 19 on the casing body inner surface and the attached pressure distribution passages 230 of FIG. 18 on the casing body outer surface. As another illustrative, non-exclusive example, this may include the eccentric annular structure of FIG. 21 that is coated with fluid-permeable coating 266 of FIG. 19.

Figure 22:
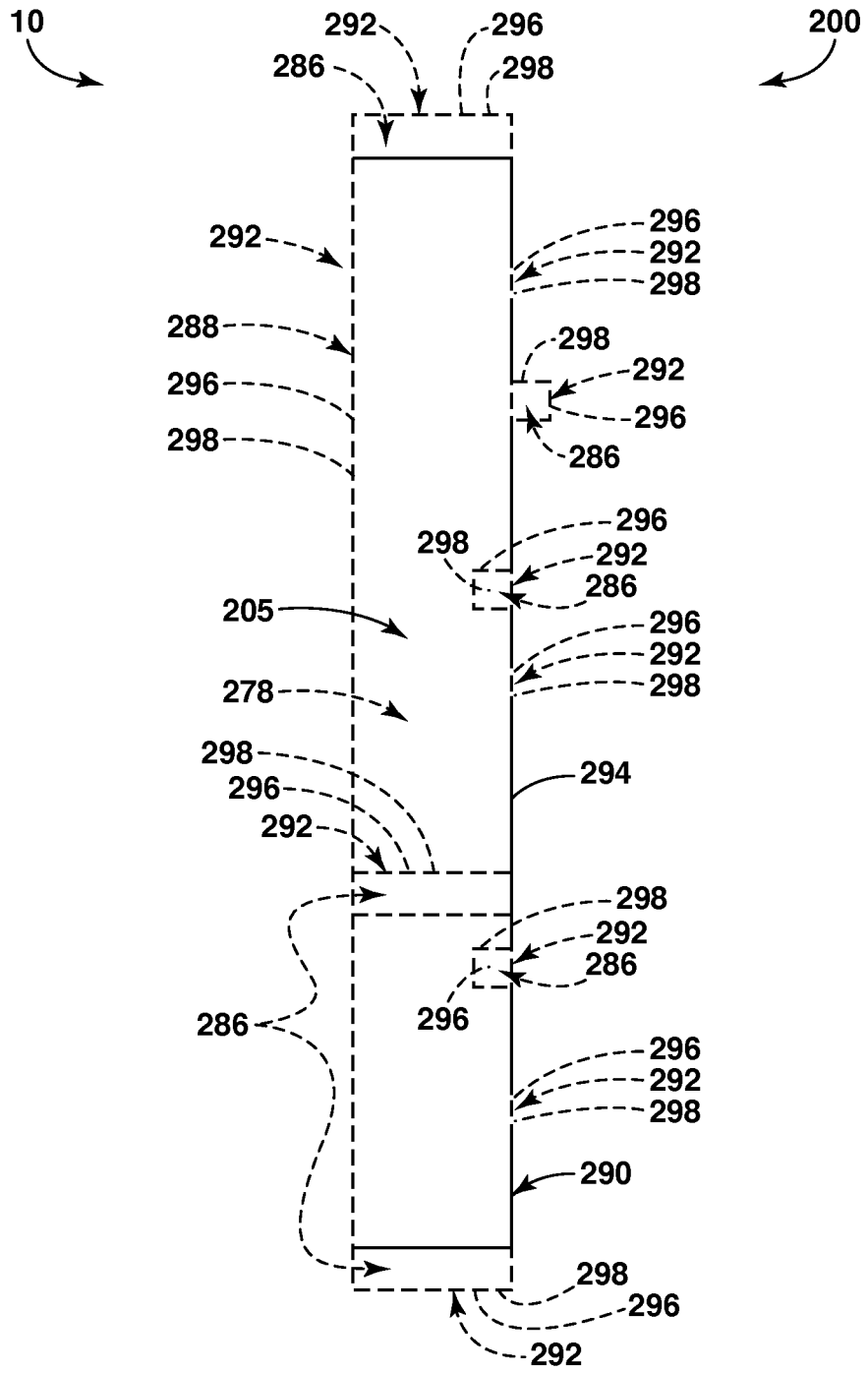
FIG. 22 is a longitudinal schematic cross-sectional view of an illustrative, non-exclusive example of a pressure distribution passage according to the present disclosure, wherein the pressure distribution passage may include a plurality of fluid-permeable surfaces, openings, filler materials, and/or flow control devices.

FIG. 22 provides a schematic longitudinal cross-sectional view of an illustrative, non-exclusive example of pressure distribution passage 205 according to the present disclosure. FIG. 22 illustrates that pressure distribution passages 205 according to the present disclosure may include one or more fluid inlets 296 and one or more fluid outlets 298. The fluid inlets and/or fluid outlets may provide fluid flow in a single direction or in two directions and may include fluid flow control structures that may meter, control and/or regulate the flow of fluid into, out of, and through the pressure distribution passages.

As shown in FIG. 22, pressure distribution passages according to the present disclosure may include one or more optional flow control devices 286. It is within the scope of the present disclosure that flow control devices 286 may control fluid flow in any suitable direction within pressure distribution passage 205, including controlling fluid flow in a direction that is generally parallel to a longitudinal axis of the pressure distribution passage (i.e., along a length of the pressure distribution passage and/or in the general direction of fluid flow) as well as controlling fluid flow in a direction that is generally perpendicular to the longitudinal axis of the pressure distribution passage (i.e., through a surface 288, 290 of the pressure distribution passage). It is also within the scope of the present disclosure that flow control devices 286 may be present at any suitable location within the pressure distribution passage, including within the pressure distribution passage, at an end of the pressure distribution passage, on an inner surface of a pressure distribution passage wall 294, within the pressure distribution passage wall, and/or on an outer surface of the pressure distribution passage wall. Illustrative, non-exclusive examples of flow control devices according to the present disclosure include any suitable permeable membrane, screen, valve, check valve, end cap, mechanical flapper, disappearing plug, pressure regulator, nozzle, tube, tortuous passage, or swellable packoff.

As also shown in FIG. 22, pressure distribution passage 205 may include any suitable number of fluid communication pathways 292 that may provide for fluid flow into and/or out of the pressure distribution passage and may serve as the fluid inlet 296, the fluid outlet 298, or a combination of the two. These fluid communication pathways may be located at predetermined and/or random locations along the length of the pressure distribution passage and/or may be continuous along at least a portion of the length of the pressure distribution passage, as shown by fluid-permeable surface 288. Fluid-impermeable surface 290 may obstruct the flow of fluid therethrough and instead direct fluid flow to the fluid inlets and/or fluid outlets associated with flow control devices 286, fluid communication pathways 292, and/or fluid-permeable surface 288.

Casing body 160 and/or pressure distribution passages 205 may include any suitable material properties and may include any suitable material and/or methods of construction. It is within the scope of the present disclosure that casing body 160 and/or pressure distribution passages 205 may include a rigid structure, illustrative, non-exclusive examples of which may include a metallic structure, such as a steel structure or a stainless steel structure. It is also within the scope of the present disclosure that the casing body and/or the pressure distribution passages may be resistant to chemical attack, such as corrosion, degradation, reaction, etc., by the materials contained within and/or associated with subterranean well 10, may be designed to withstand the pressures, stresses, and/or strains that they will experience within subterranean well 10, and may be designed to withstand the temperatures and/or temperature variations that they will experience within the subterranean well.

Pressure distribution casing 200 has been discussed as including pressure distribution passages that serve to distribute annular pressure along the length of the pressure distribution casing and/or between the terminal end of the pressure distribution casing and the subterranean formation. However, it is also within the scope of the present disclosure that pressure distribution casing 200 may be adapted, configured, and/or designed to regulate or control a pressure differential along a length of the pressure distribution casing and/or between an annular space near a terminal end of the pressure distribution casing and the subterranean formation. As an illustrative, non-exclusive example, pressure distribution casing 200 may be configured to maintain a given (i.e., desired, predetermined, and/or selected) relationship between the annular space pressure at a given depth and a subterranean formation pressure at the given depth. This may include maintaining the annular space pressure to be greater than, equal to, or less than the subterranean formation pressure at the given depth. As an illustrative, non-exclusive example, the pressure distribution casing may maintain the annular space pressure to be at least 10 pounds per square inch (psi) greater than the subterranean formation pressure at the given depth, including annular space pressures that are at least 50 psi, at least 100 psi, at least 250 psi, at least 500 psi, at least 1000 psi, or at least 2500 psi greater than the subterranean formation pressure at the given depth.

The systems and method disclosed herein have been described with reference to a subterranean well that provides a hydraulic connection between a surface region and a subterranean formation that includes a reservoir containing reservoir fluid. It is within the scope of the present disclosure that the reservoir may include a hydrocarbon reservoir, such as an oil reservoir and/or a natural gas reservoir, and that the reservoir fluid may include one or more hydrocarbons, such as oil and/or natural gas. It is also within the scope of the present disclosure that the surface region may be at any suitable location, illustrative, non-exclusive examples of which include surface regions that are located on land, surface regions that are located under water and/or on the sea floor, and/or surface regions that are located on any suitable offshore platform, including a floating platform or a fixed platform.

It is within the scope of the present disclosure that the systems and methods disclosed herein may be utilized with any suitable casing string within any suitable subterranean well. Thus, it is within the scope of the present disclosure that the surface casing string, intermediate casing string(s), and/or the production casing string may include or be the pressure distribution casing string and/or that a plurality of casing strings may include pressure distribution casing string(s).

The systems and methods disclosed herein have been described with reference to the use of the pressure distribution casing string, pressure distribution casing, and/or pressure distribution passages to distribute the annular pressure along the length of the pressure distribution conduit and/or to vent the annular pressure from the annular space to a portion of the subsurface region. As discussed in more detail herein, this annular pressure may be the result of confined fluids contained within the annular space. Thus, it is within the scope of the present disclosure that the systems and methods disclosed herein also may distribute the confined fluids along the length of the pressure distribution conduit and/or to vent the confined fluids from the annular space to a portion of the subsurface region. Additionally or alternatively, it is also within the scope of the present disclosure that the systems and methods disclosed herein may be utilized to vent the annular pressure and/or annular fluids to any suitable location, illustrative, non-exclusive examples of which include any suitable portion of the subsurface region, the subterranean formation, the reservoir, and/or the surface region.

The pressure distribution casings disclosed herein may be fabricated using any suitable technique and at any suitable location. As illustrative, non-exclusive examples, the pressure distribution casings may be fabricated in a pipe yard, in a staging area, at the subterranean well site, and/or in situ within the subterranean well. It is within the scope of the present disclosure that the pressure distribution casings disclosed herein may be at least substantially similar to other casing sections that are traditionally utilized in subterranean wells. This may include pressure distribution casings that appear substantially similar to more traditional casing sections, pressure distribution casings that function in a manner that is substantially similar to traditional casing sections, and/or pressure distribution casings that may be handled in a manner that is substantially similar to that used for traditional casing sections. Thus, the pressure distribution casings disclosed herein may be utilized without a substantial impact on traditional transportation, inspection, and/or installation procedures, equipment, and/or infrastructure.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any of the references that are incorporated by reference herein define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A pressure distribution casing adapted to distribute fluid within a subterranean well, the pressure distribution casing comprising:

a casing body including a casing body internal passage, a casing body inner surface, a casing body outer surface, and a casing body longitudinal axis; and a plurality of pressure distribution passages configured to provide a fluid flow along a surface of the pressure distribution casing, and optionally along at least one of the casing body inner surface and the casing body outer surface.

A2. The pressure distribution casing of paragraph A1, wherein the pressure distribution casing includes a monolithic structure that defines at least one of the casing body internal passage and a portion of the plurality of pressure distribution passages.

A3. The pressure distribution casing of any of paragraphs A1-A2, wherein the pressure distribution casing includes a composite structure that defines at least one of the casing body internal passage and a portion of the plurality of pressure distribution passages.

A4. The pressure distribution casing of any of paragraphs A1-A3, wherein at least one of the casing body internal passage and a portion of the plurality of pressure distribution passages is formed by extrusion.

A5. The pressure distribution casing of any of paragraphs A1-A4, wherein at least one of the casing body internal passage and a portion of the plurality of pressure distribution passages is formed by removing a portion of a material that comprises the casing body.

A6. The pressure distribution casing of paragraph A5, wherein the material is removed by at least one of milling, machining, drilling, sanding, punching, scratching, scraping, knurling, mechanical abrasion, electrical discharge machining, and water discharge machining.

A7. The pressure distribution casing of any of paragraphs A1-A6 wherein at least one of the casing body internal passage and a portion of the plurality of pressure distribution passages is formed by the inclusion of at least a first discrete pressure distribution passage within the casing body.

A8. The pressure distribution casing of any of paragraphs A1-A7, wherein a portion of the plurality of pressure distribution passages includes at least a first discrete pressure distribution passage that is operatively attached to the casing body.

A9. The pressure distribution casing of paragraph A8, wherein the at least a first discrete pressure distribution passage is operatively attached using at least one of a fixture, a fastener, a clasp, an adhesive, a weld, a braze, a bond, and threads.

A10. The pressure distribution casing of any of paragraphs A1-A9, wherein the pressure distribution casing has a fluid-permeable coating that forms a portion of the plurality of pressure distribution passages.

A11. The pressure distribution casing of paragraph A10, wherein the fluid-permeable coating includes at least one of a porous foam, a sintered material, and a packed bed.

A12. The pressure distribution casing of any of paragraphs A10-A11, wherein at least a portion of the fluid-permeable coating is covered by a fluid-permeable layer.

A13. The pressure distribution casing of any of paragraphs A10-A12, wherein at least a portion of the fluid-permeable coating is covered by a fluid-impermeable layer.

A14. The pressure distribution casing of paragraph A13, wherein the fluid-impermeable layer includes at least a first discontinuity, and further wherein the at least a first discontinuity is fluid-permeable, and optionally wherein the at least a first discontinuity is at least one of randomly located and systematically located.

A15. The pressure distribution casing of any of paragraphs A1-A14, wherein a portion of the plurality of pressure distribution passages includes channels.

A16. The pressure distribution casing of paragraph A15, wherein the channels include at least one of open channels and enclosed channels, and further wherein the enclosed channels include a cover extending over at least a portion of the enclosed channels.

A17. The pressure distribution casing of any of paragraphs A1-A16, wherein a portion of the plurality of pressure distribution passages comprises a porous material contained within at least a portion of an annular space.

A18. The pressure distribution casing of paragraph A17, wherein the porous material includes at least one of a packed bed, a sintered material, and a porous foam.

A19. The pressure distribution casing of any of paragraphs A17-A18, wherein the portion of the annular space includes at least one of some but not all of the annular space and all of the annular space.

A20. The pressure distribution casing of any of paragraphs A1-A19, wherein at least a portion of the plurality of pressure distribution passages further contains a filler material.

A21. The pressure distribution casing of paragraph A20, wherein the filler material includes at least one of a fluid-permeable solid, optionally including a foam, a sintered material, or a packed bed; a meltable solid, optionally including a wax or ice; a soluble solid, optionally including a soluble polymer, a water-soluble polymer, or an oil-soluble polymer; a liquid, and a gas.

A22. The pressure distribution casing of any of paragraphs A1-A21, wherein at least a portion of the plurality of pressure distribution passages further includes an evacuated space.

A23. The pressure distribution casing of any of paragraphs A1-A22, wherein at least a portion of the plurality of pressure distribution passages further includes at least a first flow control device configured to control the fluid flow therethrough.

A24. The pressure distribution casing of paragraph A23, wherein the at least a first flow control device includes at least one of a permeable membrane, a screen, a check valve, an end cap, a mechanical flapper, a disappearing plug, and a swellable packoff.

A25. The pressure distribution casing of any of paragraphs A1-A24, wherein a portion of the plurality of pressure distribution passages extends along some but not all of the casing body.

A26. The pressure distribution casing of any of paragraphs A1-A25, wherein a portion of the plurality of pressure distribution passages extends along all of the casing body.

A27. The pressure distribution casing of any of paragraphs A1-A26, wherein at least a portion of the plurality of pressure distribution passages is continuous along a surface of the casing body.

A28. The pressure distribution casing of any of paragraphs A1-A27, wherein at least a portion of the plurality of pressure distribution passages is discontinuous along a surface of the casing body.

A29. The pressure distribution casing of paragraph A28, wherein the portion of the plurality of pressure distribution passages extends over at least 1% of the surface of the casing body, optionally including extending over at least 5%, at least 10%, at least 25%, at least 50%, or 100% of the surface of the casing body.

A30. The pressure distribution casing of any of paragraphs A28-A29, wherein the portion of the plurality of pressure distribution passages extend over at least 1% of a length of the casing body, optionally including extending over at least 5%, at least 10%, at least 25%, at least 50%, or 100% of the length of the casing body.

A31. The pressure distribution casing of any of paragraphs A1-A30, wherein at least a portion of the plurality of pressure distribution passages is aligned parallel to the longitudinal axis of the pressure distribution casing.

A32. The pressure distribution casing of any of paragraphs A1-A31, wherein at least a portion of the plurality of pressure distribution passages is aligned perpendicular to the longitudinal axis of the pressure distribution casing.

A33. The pressure distribution casing of any of paragraphs A1-A32, wherein at least a portion of the plurality of pressure distribution passages is aligned at a skew angle relative to the longitudinal axis of the pressure distribution casing.

A34. The pressure distribution casing of any of paragraphs A1-A33, wherein at least a portion of the plurality of pressure distribution passages is aligned tangential to the outer surface of the pressure distribution casing.

A35. The pressure distribution casing of any of paragraphs A1-A34, wherein at least a portion of the plurality of pressure distribution passages is aligned randomly.

A36. The pressure distribution casing of any of paragraphs A1-A35, wherein at least a portion of the plurality of pressure distribution passages is aligned systematically.

A37. The pressure distribution casing of any of paragraphs A1-A36, wherein at least a portion of the plurality of pressure distribution passages forms a tortuous flow path.

A38. The pressure distribution casing of any of paragraphs A1-A37, wherein at least a first portion of the plurality of pressure distribution passages intersects at least a second portion of the plurality of pressure distribution passages.

A39. The pressure distribution casing of any of paragraphs A1-A38, wherein at least a portion of the plurality of pressure distribution passages includes at least a first fork, optionally including a plurality of forks.

A40. The pressure distribution casing of any of paragraphs A1-A39, wherein each of the plurality of pressure distribution passages includes at least a first fluid inlet.

A41. The pressure distribution casing of any of paragraphs A1-A40, wherein each of the plurality of pressure distribution passages includes at least a first fluid outlet.

A42. The pressure distribution casing of paragraph A41, wherein at least one of the at least a first fluid inlet and the at least a first fluid outlet is placed at a predetermined location in the pressure distribution passage.

A43. The pressure distribution casing of any of paragraphs A41-A42, wherein at least one of the at least a first fluid inlet and the at least a first fluid outlet is placed at a random location in the pressure distribution passage.

A44. The pressure distribution casing of any of paragraphs A1-A43, wherein the casing body is a rigid casing body.

A45. The pressure distribution casing of any of paragraphs A1-A44, wherein the casing body is a metallic casing body, and optionally wherein the metallic casing body includes at least one of steel and stainless steel.

A46. The pressure distribution casing of any of paragraphs A1-A45, wherein at least a portion of the fluid flow is along the casing body inner surface.

A47. The pressure distribution casing of any of paragraphs A1-A46, wherein at least a portion of the fluid flow is along the casing body outer surface.

A48. The pressure distribution casing of any of paragraphs A1-A47, wherein at least a portion of the fluid flow is within a casing body wall.

A49. The pressure distribution casing of any of paragraphs A1-A48, wherein at least a portion of the fluid flow is generally parallel to the casing body longitudinal axis.

A50. The pressure distribution casing of any of paragraphs A1-A49, wherein the fluid flow is not through a casing body wall.

A51. The pressure distribution casing of any of paragraphs A1-A50, wherein a characteristic cross-sectional dimension of a portion of the plurality of pressure distribution passages is less than 3 cm, optionally including characteristic cross-sectional dimensions of less than 2.5 cm, less than 2 cm, less than 1.5 cm, less than 1 cm, less than 0.9 cm, less than 0.8 cm, less than 0.7 cm, less than 0.6 cm, less than 0.5 cm, less than 0.4 cm, less than 0.3 cm, less than 0.2 cm, and less than 0.1 cm, and further optionally including characteristic cross-sectional dimensions of 0.1-0.2 cm, 0.1-0.3 cm, 0.1-0.5 cm, 0.5-1 cm, and 1-3 cm.

A52. The pressure distribution casing of any of paragraphs A1-A51, wherein a characteristic cross-sectional dimension of a portion of the plurality of pressure distribution passages is less than 20% of a characteristic cross-sectional dimension of the casing body, optionally including characteristic cross sectional dimensions of the portion of the plurality of pressure distribution passages that are less than 15%, less than 10%, less than 5%, or less than 1% of the characteristic cross-sectional dimension of the casing body.

A53. The pressure distribution casing of any of paragraphs A1-A52, wherein a characteristic cross-sectional dimension of a portion of the plurality of pressure distribution passages is less than 75% of a characteristic wall thickness of the casing body, optionally including characteristic cross sectional dimensions of the portion of the plurality of pressure distribution passages that are less than 50%, less than 25%, less than 10%, or less than 5% of the characteristic wall thickness of the casing body.

A54. The pressure distribution casing of any of paragraphs A1-A53, wherein the pressure distribution casing includes more than 2 pressure distribution passages, optionally including more than 5, more than 10, more than 25, more than 50, more than 75, more than 100, or more than 250 pressure distribution passages.

A55. The pressure distribution casing of any of paragraphs A1-A54, wherein at least a portion of the plurality of pressure distribution passages is associated with the casing body inner surface.

A56. The pressure distribution casing of paragraph A55, wherein the portion of the plurality of pressure distribution passages that is associated with the casing body inner surface is at least one of operatively attached to the casing body inner surface, and forming a portion of the casing body inner surface.

A57. The pressure distribution casing of any of paragraphs A1-A56, wherein at least a portion of the plurality of pressure distribution passages is associated with the casing body outer surface.

A58. The pressure distribution casing of paragraph A57, wherein the portion of the plurality of pressure distribution passages that is associated with the casing body outer surface is at least one of operatively attached to the casing body outer surface and forming a portion of the casing body outer surface.

A59. The pressure distribution casing of any of paragraphs A1-A58, wherein the casing body is defined between the casing body inner surface and the casing body outer surface, and further wherein at least a portion of the plurality of pressure distribution passages is located within the casing body.

A60. The pressure distribution casing of paragraph A59, wherein the portion of the plurality of pressure distribution passages that are located within the casing body are at least one of formed from the casing body, fabricated within the casing body, and located within the casing body.

B1. A pressure distribution casing string, comprising:

a plurality of casing sections, wherein at least one of the plurality of casing sections is the pressure distribution casing of any of paragraphs A1-A60, and further wherein the plurality of casing sections are operatively attached to one another along a longitudinal axis.

B2. The pressure distribution casing string of paragraph B1, wherein the pressure distribution casing string includes at least a first pressure distribution casing operatively attached to at least a second pressure distribution casing.

B3. The pressure distribution casing string of paragraph B2, wherein at least one of the plurality of pressure distribution passages in the at least a first pressure distribution casing is continuous from the at least a first pressure distribution casing to the at least a second pressure distribution casing.

B4. The pressure distribution casing string of any of paragraphs B2-B3, wherein at least one of the plurality of pressure distribution passages in the at least a first pressure distribution casing is discontinuous from the at least a first pressure distribution casing to the at least a second pressure distribution casing.

B5. The pressure distribution casing string of any of paragraphs B1-B4, wherein some but not all of the plurality of casing sections are pressure distribution casings.

B6. The pressure distribution casing string of any of paragraphs B1-B4, wherein all of the plurality of casing sections are pressure distribution casings.

C1. A subterranean well configured to provide a hydraulic connection between a surface region and a subterranean formation that includes a reservoir containing a reservoir fluid, and further wherein the subterranean well includes a wellbore that extends between the surface region and the subterranean formation, the subterranean well comprising:

at least one pressure distribution casing string as described in any of paragraphs B1-B6, wherein the pressure distribution casing string is contained within the wellbore.

C2. The subterranean well of paragraph C1, wherein the subterranean well further includes at least one additional conduit, wherein at least a portion of at least one of the pressure distribution casing string and the at least one additional conduit is contained within at least a portion of the other of the pressure distribution casing string and the at least one additional conduit to define an annular space.

C3. The subterranean well of paragraph C2, wherein the at least one additional conduit is a pressure distribution casing string.

C4. The subterranean well of paragraph C2, wherein the at least one additional conduit is a casing string.

C5. The subterranean well of paragraph C2, wherein the at least one additional conduit is a production tubing string.

C6. The subterranean well of any of paragraphs C2-C5, wherein the subterranean well further includes a hydraulic seal in at least a portion of the annular space.

C7. The subterranean well of paragraph C6, wherein the at least one additional conduit includes a subsurface end, and further wherein the hydraulic seal is located proximal to the subsurface end of the at least one additional conduit.

C8. The subterranean well of any of paragraphs C2-C7, wherein at least one of the plurality of pressure distribution passages provides fluid communication between the annular space and the subterranean formation.

C9. The subterranean well of paragraph C8, wherein the fluid communication is between the annular space and a portion of the subterranean formation below a casing shoe that is operatively attached to the first casing string.

C10. The subterranean well of any of paragraphs C2-C9, wherein a distance between the surface region and a portion of the pressure distribution casing string defines a depth, the annular space has an annular space pressure at the depth, and the subterranean formation has a subterranean formation pressure at the depth, and further wherein the pressure distribution passages are adapted to maintain the annular space pressure higher at the depth than the subterranean formation pressure at the depth.

C11. The subterranean well of paragraph C10, wherein the annular space pressure at the depth is at least 10 psi greater than the subterranean formation pressure at the depth, optionally including annular space pressures at the depth that are at least 50 psi, at least 100 psi, at least 250 psi, at least 500 psi, at least 1000 psi, or at least 2500 psi greater than the subterranean formation pressure at the depth.

C12. The subterranean well of any of paragraphs C1-C11, wherein the reservoir includes a hydrocarbon reservoir and the reservoir fluid includes a hydrocarbon.

C13. The subterranean well of paragraph C12, wherein the hydrocarbon includes oil, and the subterranean well is an oil well.

C14. The subterranean well of paragraph C12, wherein the hydrocarbon includes natural gas, and the subterranean well is a natural gas well.

C15. The subterranean well of any of paragraphs C1-C14, wherein the surface region is located on land.

C16. The subterranean well of any of paragraphs C1-C15, wherein the surface region is located on the sea floor.

C17. The subterranean well of any of paragraphs C1-C16, wherein the surface region is located on an offshore platform, and optionally wherein the offshore platform includes at least one of a floating platform and a fixed platform.

C18. The subterranean well of any of paragraphs C1-C17, wherein at least a portion of the pressure distribution casing string is operatively attached to the wellbore.

C19. The subterranean well of paragraph C18, wherein the portion of the pressure distribution casing string is operatively attached to the wellbore with a hydraulic seal.

C20. The subterranean well of paragraph C19, wherein the hydraulic seal includes cement.

C21. The subterranean well of any of paragraphs C1-C20, wherein the pressure distribution casing string includes a surface casing string.

C22. The subterranean well of any of paragraphs C1-C21, wherein the pressure distribution casing string includes an intermediate casing string.

C23. The subterranean well of any of paragraphs C1-C22, wherein the pressure distribution casing string includes a production casing string.

D1. A pressure distribution casing adapted to distribute fluid within a subterranean well, the pressure distribution casing comprising:

a casing body including a casing body internal passage, a casing body inner surface, and a casing body outer surface, wherein the casing body defines a casing body longitudinal axis; and a means for providing a plurality of pressure distribution streams that are configured to provide a fluid flow along a surface of the pressure distribution casing.

D2. The pressure distribution casing of paragraph D1, wherein the means for providing a plurality of pressure distribution streams includes any suitable structure described in any of paragraphs A1-C21.

D3. The pressure distribution casing of any of paragraphs D1-D2, wherein the casing body includes a casing body wall, and further wherein the means for providing a plurality of pressure distribution streams does not include pressure distribution streams that flow through the casing wall.

D4. A pressure distribution casing string comprising:

a plurality of casing sections, wherein at least one of the plurality of casing sections is the pressure distribution casing of any of paragraphs D1-D3, and further wherein the plurality of casing sections are operatively attached to one another along a longitudinal axis.

D5. A subterranean well configured to provide a hydraulic connection between a surface region and a subterranean formation that includes a reservoir containing a reservoir fluid, and further wherein the subterranean well includes a wellbore that extends between the surface region and the subterranean formation, the subterranean well comprising:

at least one pressure distribution casing string as described in paragraph D4, wherein the pressure distribution casing string is contained within the wellbore.

E1. A method of producing oil including any of the systems of paragraphs A1-D5.

E2. A method of regulating the pressure in an annular space between two casing strings including the use of any of the systems of paragraphs A1-D5.

E3. A method of regulating the pressure in an annular space between two casing strings contained within a subterranean formation, the method comprising:

providing the pressure distribution casing of any of paragraphs A1-A60; and relieving a pressure in the annular space by flowing a trapped annular fluid through the pressure distribution passages from the annular space into the subterranean formation.

E4. A method of fabricating the pressure distribution casing of any of paragraphs A1-D5.

F1. The use of any of the methods of any of paragraphs E1-E4 with any of the systems of paragraphs A1-D5.

F2. The use of any of the systems of paragraphs A1-D5 with any of the methods of any of paragraphs E1-E4.

Additional illustrative, non-exclusive examples of systems according to the present disclosure include:

G1. A pressure distribution casing adapted to distribute fluid within a subterranean well, the pressure distribution casing comprising:

a casing body including a casing body internal passage, a casing body inner surface, and a casing body outer surface, wherein the casing body defines a casing body longitudinal axis; and a plurality of pressure distribution passages configured to provide a fluid flow along at least one of the casing body inner surface and the casing body outer surface.

G2. The pressure distribution casing of paragraph G1, wherein the pressure distribution casing includes a monolithic structure that defines at least one of the casing body internal passage and a portion of the plurality of pressure distribution passages.

G3. The pressure distribution casing of any of paragraphs G1-G2, wherein the pressure distribution casing includes a composite structure that defines at least one of the casing body internal passage and a portion of the plurality of pressure distribution passages.

G4. The pressure distribution casing of paragraph G3, wherein a portion of the plurality of pressure distribution passages is formed by the inclusion of at least a first discrete pressure distribution passage within the casing body.

G5. The pressure distribution casing of any of paragraphs G3-G4, wherein a portion of the plurality of pressure distribution passages includes at least a first discrete pressure distribution passage that is operatively attached to the casing body.

G6. The pressure distribution casing of any of paragraphs G3-G5, wherein the pressure distribution casing includes a fluid-permeable coating that forms a portion of the plurality of pressure distribution passages.

G7. The pressure distribution casing of any of paragraphs G1-G6, wherein at least a portion of the plurality of pressure distribution passages further contains a filler material.

G8. The pressure distribution casing of any of paragraphs G1-G7, wherein at least a portion of the plurality of pressure distribution passages further includes at least a first flow control device configured to control the fluid flow therethrough.

G9. The pressure distribution casing of any of paragraphs G1-G8, wherein the fluid flow is not between the casing body inner surface and the casing body outer surface.

G10. A pressure distribution casing string comprising:

a plurality of casing sections, wherein at least one of the plurality of casing sections is the pressure distribution casing of any of paragraphs G1-G9, and further wherein the plurality of casing sections are operatively attached to one another along their casing body longitudinal axes.

G11. A subterranean well configured to provide a hydraulic connection between a surface region and a subterranean formation that includes a reservoir containing a reservoir fluid, wherein the subterranean well includes a wellbore that extends between the surface region and the subterranean formation, the subterranean well comprising:

the pressure distribution casing string of paragraph G10 contained within the wellbore; and at least one additional conduit, wherein at least a portion of at least one of the pressure distribution casing string and the at least one additional conduit is contained within at least a portion of the other of the pressure distribution casing string and the at least one additional conduit to define an annular space.

G12. The subterranean well of paragraph G11, wherein a portion of the plurality of pressure distribution passages comprises a porous material contained within at least a portion of the annular space.

G13. The subterranean well of any of paragraphs G11-G12, wherein at least one of the plurality of pressure distribution passages provides fluid communication between at least a first point proximal the pressure distribution casing string and at least a second point proximal the pressure distribution casing string, wherein the first point is different from the second point.

G14. The subterranean well of any of paragraphs G12-G13, wherein at least one of the plurality of pressure distribution passages provides fluid communication between the annular space and the subterranean formation.

G15. The subterranean well of any of paragraphs G12-G14, wherein the reservoir includes a hydrocarbon reservoir and the reservoir fluid includes a hydrocarbon.

H1. A method of managing pressure within a subterranean well that includes a pressure distribution casing, wherein the pressure distribution casing includes a casing body, a casing body internal passage, a casing body inner surface, and a casing body outer surface, and further wherein the pressure distribution casing includes a plurality of pressure distribution passages configured to provide a fluid flow along at least one of the casing body inner surface and the casing body outer surface, the method comprising:

responsive to an increase in pressure within a length of the casing body internal passage, flowing a fluid within the casing body internal passage into through at least a portion of the plurality of pressure distribution passages, wherein the flowing includes decreasing the pressure within the length of the pressure distribution casing internal passage.

H2. The method of paragraph H1, wherein the casing body defines a casing body longitudinal axis, and further wherein the flowing includes flowing the fluid along the casing body longitudinal axis.

H3. The method of paragraph H1 or H2, wherein the method further includes releasing at least a portion of the fluid into at least one of a surface region and a subsurface region.

H4. The method of any of paragraphs H1-H3, wherein the method further includes producing a reservoir fluid from the subterranean well, wherein the producing includes flowing the reservoir fluid through the casing body internal passage and from a subsurface region to a surface region.

H5. The method of paragraph H4, wherein the producing includes selectively flowing the reservoir fluid through at least one of the plurality of pressure distribution passages.

H6. The method of any of paragraphs H1-H5, wherein the method further includes releasing a confined fluid from within at least a portion of the plurality of pressure distribution passages.

H7. The method of any of paragraphs H1-H6, wherein the subterranean well further includes at least one additional conduit, wherein at least a portion of at least one of the pressure distribution casing and the at least one additional conduit is contained within at least a portion of the other of the pressure distribution casing and the at least one additional conduit to define an annular space, wherein the confined fluid is contained within the annular space, and further wherein the flowing includes decreasing a pressure within the annular space.

H8. The method of any of paragraphs H1-H7, wherein the plurality of pressure distribution passages are associated with the casing body internal surface.

H9. The method of any of paragraphs H1-H7, wherein the plurality of pressure distribution passages extend within the casing body between the casing body internal surface and the casing body external surface without fluidly interconnecting the casing body internal surface with the casing body external surface.

H10. A method of producing a reservoir fluid from a subterranean well that includes a pressure distribution casing, wherein the pressure distribution casing includes a casing body, a casing body internal passage, a casing body inner surface, and a casing body outer surface, and further wherein the pressure distribution casing includes a plurality of pressure distribution passages configured to provide a fluid flow along at least one of the casing body inner surface and the casing body outer surface, the method comprising:

flowing the reservoir fluid through the casing body internal passage and from a subsurface region to a surface region; and responsive to an increase in pressure within a portion of the casing body internal passage, decreasing the pressure within the portion of the casing body internal passage by distributing fluid through a portion of the plurality of pressure distribution passages.

H11. The method of paragraph H10, wherein the method further includes the steps of any of paragraphs H1-H3 and H6-H9.

H12. A method of producing a reservoir fluid from a subterranean well that includes a pressure distribution casing, wherein the pressure distribution casing includes a casing body, a casing body internal passage, a casing body inner surface, and a casing body outer surface, and further wherein the pressure distribution casing includes a plurality of pressure distribution passages configured to provide a fluid flow along at least one of the casing body inner surface and the casing body outer surface, the method comprising:

flowing the reservoir fluid through the casing body internal passage and from a subsurface region to a surface region;

responsive to an increase in pressure within a portion of the casing body internal passage, decreasing the pressure within the portion of the casing body internal passage by distributing fluid through a portion of the plurality of pressure distribution passages; and producing a reservoir fluid from the subterranean well.

H13. The method of paragraph H12, wherein the method further includes the steps of any of paragraphs H1-H3 and H6-H9.

INDUSTRIAL APPLICABILITY

The systems and methods disclosed herein are applicable to the oil and gas industry. It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A subterranean well configured to provide a hydraulic connection between a surface region and a subterranean formation that includes a reservoir containing a reservoir fluid, wherein the subterranean well includes a wellbore that extends between the surface region and the subterranean formation, the subterranean well comprising:

a pressure distribution casing string contained within the wellbore, wherein the pressure distribution casing string includes a plurality of casing sections operatively attached to one another along a longitudinal axis, wherein at least one of the plurality of casing sections is a pressure distribution casing adapted to distribute fluid within the subterranean well and the pressure distribution casing comprising;

a casing body including a casing body internal passage, a casing body inner surface, and a casing body outer surface, wherein the casing body defines a casing body longitudinal axis; and a plurality of pressure distribution passages configured to provide a fluid flow along a surface of the pressure distribution casing; and at least one additional conduit;

wherein at least a portion of at least one of the pressure distribution casing string and the at least one additional conduit is concentrically contained within at least a portion of the other of the pressure distribution casing string and the at least one additional conduit to define an annular space;

wherein at least one of the plurality of pressure distribution passages fluidly connects the annular space with a casing shoe on at least one of the pressure distribution casing and the at least one additional conduit such that the annulus may be in fluid communication along the wellbore longitudinal axis with at least a portion of the subterranean formation; and wherein the plurality of pressure distribution passages do not connect the casing body internal passage with the annular space.

2. The subterranean well of claim 1, wherein the at least one additional conduit includes at least one of a second pressure distribution casing string, a casing string, and a production tubing string.

3. The subterranean well of claim 1, wherein the pressure distribution casing string includes at least a first pressure distribution casing operatively attached to at least a second pressure distribution casing.

4. The subterranean well of claim 3, wherein at least one of the plurality of pressure distribution passages in the at least a first pressure distribution casing is continuous from the at least a first pressure distribution casing to the at least a second pressure distribution casing.

5. The subterranean well of claim 3, wherein at least one of the plurality of pressure distribution passages in the at least a first pressure distribution casing is discontinuous from the at least a first pressure distribution casing to the at least a second pressure distribution casing.

6. The subterranean well of claim 1, wherein at least one of the plurality of pressure distribution passages provides fluid communication between the annular space and the subterranean formation.

7. The subterranean well of claim 1, wherein at least one of the plurality of pressure distribution passages provides fluid communication between at least a first point proximal the pressure distribution casing string and at least a second point proximal the pressure distribution casing string, wherein the first point is different from the second point.

8. The subterranean well of claim 1, wherein a distance between the surface region and a portion of the pressure distribution casing string defines a depth, the annular space has an annular space pressure at the depth, the subterranean formation has a subterranean formation pressure at the depth, and the pressure distribution passages are adapted to maintain the annular space pressure higher at the depth than the subterranean formation pressure at the depth.

9. The subterranean well of claim 1, wherein the reservoir includes a hydrocarbon reservoir and the reservoir fluid includes a hydrocarbon.

10. A method of managing pressure within a subterranean well, the method comprising:

providing the well with a pressure distribution casing and at least one additional conduit, wherein at least a portion of the pressure distribution casing and the at least one additional conduit is concentrically contained within at least a portion of the other of the pressure distribution casing and the at least one additional conduit to define an annular space, wherein the pressure distribution casing includes a casing body, a casing body internal passage, a casing body inner surface, and a casing body outer surface, and a plurality of pressure distribution passages configured to provide a fluid flow along at least one of the casing body inner surface and the casing body outer surface, and wherein the plurality of pressure distribution passages do not connect the casing body internal passage with the annular space; and responsive to an increase in pressure within a length of the casing body internal passage, flowing a fluid within the casing body internal passage through at least a portion of the plurality of pressure distribution passages, wherein the flowing includes decreasing the pressure within the length of the pressure distribution casing internal passage.

11. The method of claim 10, wherein the method further includes producing a reservoir fluid from the subterranean well, wherein the producing includes flowing the reservoir fluid through the casing body internal passage and from a subsurface region to a surface region.

12. The method of claim 11, wherein the producing includes selectively flowing the reservoir fluid through at least one of the plurality of pressure distribution passages.

13. The method of claim 10, wherein the method further includes releasing a confined fluid from within at least a portion of the plurality of pressure distribution passages.

14. The method of claim 13, wherein the subterranean well further includes at least one additional conduit, wherein at least a portion of at least one of the pressure distribution casing and the at least one additional conduit is contained within at least a portion of the other of the pressure distribution casing and the at least one additional conduit to define an annular space, wherein the confined fluid is contained within the annular space, and further wherein the flowing includes decreasing a pressure within the annular space.

15. A method of producing a reservoir fluid from a subterranean well, the method comprising:

providing the well with a pressure distribution casing and at least one additional conduit, wherein at least a portion of the pressure distribution casing and the at least one additional conduit is concentrically contained within at least a portion of the other of the pressure distribution casing and the at least one additional conduit to define an annular space, wherein the pressure distribution casing includes a casing body, a casing body internal passage, a casing body inner surface, and a casing body outer surface, and a plurality of pressure distribution passages configured to provide a fluid flow along at least one of the casing body inner surface and the casing body outer surface, and wherein the plurality of pressure distribution passages do not connect the casing body internal passage with the annular space;

flowing the reservoir fluid through the casing body internal passage and from a subsurface region to a surface region; and responsive to an increase in pressure within a portion of the casing body internal passage, decreasing the pressure within the portion of the casing body internal passage by distributing fluid through a portion of the plurality of pressure distribution passages; and producing a reservoir fluid from the subterranean well.

* * * * *